US006925797B2

(12) United States Patent
Taga et al.

(10) Patent No.: US 6,925,797 B2
(45) Date of Patent: Aug. 9, 2005

(54) APPARATUS FOR PURIFYING EXHAUST GAS OF ENGINE

(75) Inventors: Junichi Taga, Aki-gun (JP); Youichi Kuji, Aki-gun (JP)

(73) Assignee: Mazda Motor Corporation, Hiroshima (JP)

( * ) Notice: Subject to any disclaimer, the term of this patent is extended or adjusted under 35 U.S.C. 154(b) by 819 days.

(21) Appl. No.: 09/884,129

(22) Filed: Jun. 20, 2001

(65) Prior Publication Data

US 2001/0055550 A1 Dec. 27, 2001

(30) Foreign Application Priority Data

Jun. 22, 2000 (JP) ..... 2000-187600

(51) Int. Cl.[7] ..... F01N 3/10
(52) U.S. Cl. ..... 60/301; 60/276; 60/277
(58) Field of Search ..... 60/276, 295, 301, 60/277

(56) References Cited

U.S. PATENT DOCUMENTS 5,564,283 A 10/1996 Yano et al.
5,577,382 A * 11/1996 Kihara et al. ..... 60/276
5,758,493 A * 6/1998 Asik et al. ..... 60/274
5,771,685 A * 6/1998 Hepburn ..... 60/274
6,119,374 A * 9/2000 Bollard et al. ..... 36/117.3
6,237,330 B1 * 5/2001 Takahashi et al. ..... 60/285
6,263,666 B1 * 7/2001 Kubo et al. ..... 60/277
6,336,320 B1 * 1/2002 Tanaka et al. ..... 60/285
6,438,947 B2 * 8/2002 Ludwig et al. ..... 60/285
6,460,329 B2 * 10/2002 Shimotani et al. ..... 60/285

FOREIGN PATENT DOCUMENTS

EP 0 598 917 A1 12/1993
EP 0 733 787 A2 9/1996
EP 0 997 626 A1 5/2000
EP A-0997626 5/2000
JP 05-284960 A 5/1995

OTHER PUBLICATIONS

European Search Report, Application No. 01114987.9–2311 Mailing Date: Oct. 5, 2001.

* cited by examiner

*Primary Examiner*—Thomas Denion
*Assistant Examiner*—Diem Tran
(74) *Attorney, Agent, or Firm*—Nixon Peabody LLP; Donald R. Studebaker

(57) ABSTRACT

A catalyst (17) of a NOx absorbing-and-reducing type is disposed in an exhaust passage (10) of an engine (1). The catalyst (17) absorbs a NOx component in an exhaust gas under an over-oxygen atmosphere and reductively emits the absorbed NOx component according to reduction of oxygen concentration. A control unit (20) of the engine (1) estimates a momentary amount of the absorbed NOx component, and further estimates an integrated amount of the absorbed NOx component according to the integration of the momentary amounts. Then the control unit (20) lets the catalyst (17) to emit the NOx component when the integrated amount is equal to or greater than a predetermined absorption amount. In addition, the control unit (20) corrects the momentary amount to a smaller value in adverse proportion to the increase in the integrated amount.

5 Claims, 16 Drawing Sheets

APPARATUS FOR PURIFYING EXHAUST GAS OF ENGINE

BACKGROUND OF THE INVENTION

1. Field of the Invention

The present invention relates to an apparatus for purifying an exhaust gas of an engine, particularly, to the apparatus including a catalyst of a NOx absorbing-and-reducing type for purifying NOx-including exhaust gas that is emitted during a lean operation.

2. Description of the Prior Art

A three-way catalyst included in an engine for a vehicle or the like efficiently purifies harmful components, such as CO (carbon monoxide), HC (hydrocarbon), and NOx (nitrogen oxides). However, since a window is limited to a narrow range in the vicinity of a theoretical air fuel ratio ($\lambda$=1), a NOx purification ratio is lowered in a recently developed engine, such as a so-called lean burn engine, which employs a direct-injected stratified combustion method for the purpose of improving fuel consumption performance. To overcome this problem, a catalyst of a NOx absorbing-and-reducing type (which hereinbelow may simply be referred to as a "NOx catalyst") is included in an exhaust passage. At an air fuel ratio representing an over-oxygen atmosphere, the NOx catalyst absorbs the NOx component included in exhaust gases, reduces the NOx component absorbed according to a reduced oxygen concentration, and emits it.

When a lean operation continues for a long time, the absorbed NOx catalyst is saturated. Therefore, when the amount of the absorbed NOx is equal to or greater than a predetermined absorption amount, the air fuel ratio of the exhaust gas is adjusted to be rich to emit NOx from the catalyst, thereby allowing the NOx catalyst to regain the absorbing capability.

However, the NOx absorption amount, which is employed as a determination criterion for starting the aforementioned NOx emission processing, cannot be directly measured. Generally, the amount is obtained through estimation. In a typical example of the estimation, a momentary NOx absorption amount is estimated according to the operation condition in units of a predetermined cycle (for example, a control cycle or a sampling cycle), and an integrated NOx absorption amount obtained through integration of the momentary amounts is employed as a NOx amount. In this case, estimation accuracy lower and an error in the estimated amount causes various defects.

For example, when an estimated NOx absorption amount is greater than an actual amount, a case can occur in which NOx emission processing is early started while NOx is not absorbed so much as to be emitted. Also, a case can occur in which a NOx emission processing needlessly continues while NOx is completely emitted. Neither of the cases is preferable. On the other hand, when an estimated NOx absorption amount is less than an actual amount, a case can occur in which NOx emission processing does not start while NOx is absorbed sufficient to be emitted. Also, a case can occur in which NOx emission processing early stops while NOx is not yet completely emitted. Neither of the cases is preferable in terms of catalyst performance.

Under the present circumstances, various proposals have been made for techniques that allow an accurate estimate of the NOx absorption amount to be obtained. For example, as is disclosed in the Japanese Laid-open Patent Publication No. 7-139340, the NOx absorption amount is added in lean operation, and the NOx absorption amount is subtracted in either rich operation or theoretical air fuel ratio operation. In addition, the addition amount (momentary NOx absorption amount) is estimated according to the engine speed, an intake air pressure, and the like; and the subtraction amount (momentary NOx emission amount) is estimated according to, for example, an over-fuel-supply amount and a catalyst temperature.

In estimation techniques proposed to date, a significantly great deviation that cannot be ignored still occurs between an estimated amount and an actual NOx absorption amount, wherein matters still remains for improvement. As a cause for the deviation, important parameters that influence the increase/decrease in the NOx absorption amount are considered to exist in addition to parameters used to estimate a current NOx absorption amount.

SUMMARY OF THE INVENTION

In view of the present circumstances, the Inventors of the present invention have earnestly studied the problems with an object to improve the estimation accuracy of the NOx absorption amount. Consequently, the Inventors obtained findings as described below and achieved the present invention.

Specifically, the Inventors found that the momentary NOx absorption amount is greatly influenced by the integrated NOx absorption amount; particularly, the Inventors found that the greater the integrated NOx absorption amount, the less the momentary NOx absorption amount.

Specifically, according to a first aspect of the present invention, there is provided an apparatus for purifying an exhaust gas of an engine, including (i) a catalyst of a NOx absorbing-and-reducing type disposed in an exhaust passage, for absorbing a NOx component of the exhaust gas under an over-oxygen atmosphere and for reductively emitting the NOx component absorbed according to a reduction in an oxygen concentration, (ii) a momentary NOx absorption amount estimation section for estimating a momentary amount of the NOx component absorbed in the catalyst on the basis of a unit time, (iii) an integrated NOx absorption amount estimation section for estimating an integrated amount of the NOx component absorbed in the catalyst according to the integration of momentary amounts estimated by the estimation section, (iv) a NOx emitting section for letting the catalyst to emit the NOx component when the integrated amount estimated by the estimation section is equal to or greater than a predetermined absorption amount, and (v) a momentary NOx absorption amount correcting section for correcting the momentary amount estimated by the momentary NOx absorption amount estimation section to a value smaller in adverse proportion to the increase in the integrated amount estimated by the integrated NOx absorption amount estimation section.

According to the above invention (first aspect), in adverse proportion to the increase in the integrated NOx absorption amount, the momentary NOx absorption amount is reduced. Accordingly, in adverse proportion to the increase in the integrated NOx absorption amount, an increment amount of the integrated amount on the basis of a unit time is reduced. One reason therefor is considered such that, in adverse proportion to the increase in the integrated NOx absorption amount, a surface area that reacts with NOx in the NOx catalyst and in which NOx can newly be absorbed is reduced.

As a result, the accuracy in the estimation of the integrated NOx absorption amount is further improved, and minimization can be achieved for the above-described various defects in the above-described fuel consumption performance or catalyst performance, which are attributed to the excess/shortage in the estimated value of the NOx absorption amount.

A second aspect of the present invention is characterized in that, in the first aspect of the present invention, a NOx passing-through amount setting section is provided for setting the amount of a NOx component passing through without being absorbed therein. Further the NOx emitting section lets the catalyst to emit the NOx component also when a passing-through amount set by the setting section is equal to or greater than a predetermined amount.

According to the above invention (second aspect), regardless of the determination condition, the emission processing for the NOx component is executed not only when the NOx absorption amount is equal to or greater than the predetermined amount, but also when the amount of NOx that cannot be absorbed in the NOx catalyst and is therefore passed therethrough is equal to or greater than the predetermined amount.

Specifically, the absorption capability of the NOx catalyst is reduced according to the increase in the integrated NOx absorption amount, but it is reduced according to other factors. For example, the capability is also reduced according to the increase in the exhaust gas temperature (catalyst temperature). In specific, while the integrated NOx absorption amount is the same, the absorption capability of the NOx catalyst varies according to other factors. Therefore, before the integrated NOx absorption amount is employed as a criterion for determination as to whether the NOx emission processing is started, when the amount of the NOx component that passes through the NOx catalyst and that is emitted to the atmosphere, the NOx emission processing is preferably executed regardless of the current integrated NOx absorption amount. Thereby, deterioration in the NOx emission can securely be prevented.

A third aspect of the present invention is characterized in that, in the first or second aspect of the present invention, a momentary NOx supply amount setting section is provided for setting a momentary amount of the NOx component supplied on the basis of a unit time to the catalyst. Further a momentary NOx absorbable amount setting section is provided for setting a momentary amount of the NOx component that can be absorbed in the catalyst on the basis of a unit time. In addition, the momentary NOx absorption amount estimation section determines smaller one of the values of the momentary amounts, which have been set by the setting section, to be a momentary NOx absorption amount.

According to the above invention (third aspect), the momentary NOx absorption amount is rationally estimated. Specifically, when the momentary NOx absorbable amount that can be absorbed in the NOx catalyst is greater than a momentary NOx supply amount that is supplied to the NOx catalyst, since the NOx catalyst still has absorbing capacity even after the momentary NOx supply amount has completely been absorbed, the momentary NOx absorption amount is governed by the momentary NOx supply amount of which the value is less. Conversely, when the momentary NOx supply amount is greater than the momentary NOx absorbable amount, since the NOx catalyst does not have capacity to completely absorb the momentary NOx supply amount and allows part thereof to pass through, the momentary NOx absorption amount is governed by the momentary NOx absorbable amount of which the value is less.

A fourth aspect of the present invention is characterized in that, in the third aspect of the present invention, a momentary NOx initial exhaustion amount setting section is provided for setting a momentary amount of the NOx component exhausted on the basis of a unit time from a combustion chamber. Further a momentary NOx purification amount setting section is provided for setting a momentary amount of the NOx component that is reductively purified by the catalyst on the basis of a unit time. In addition, the momentary NOx supply amount setting section determines a value, which is obtained through the subtraction of a momentary NOx purification amount set by the purification amount setting section from a momentary NOx initial exhaust amount set by the exhaustion amount setting section, to be a momentary NOx supply amount.

According to the above invention (fourth aspect), an initial exhaust amount of NOx initially exhausted from the combustion chamber into an exhaust pass is not employed as it is as the NOx supply amount, but a value obtained through the subtraction of the amount of NOx, which is reductively purified before the catalyst absorbs the NOx component, from the initial exhaust amount is employed as the NOx supply amount. Therefore, the momentary NOx supply amount, which is the value of the amount of NOx supplied as an object of the catalyst absorption, is rationally and accurately set As a result, when the value of the momentary NOx supply amount is employed as the momentary NOx absorption amount, the estimation accuracy of the momentary NOx absorption amount is improved, and in addition, the estimation accuracy of the integrated NOx absorption amount is also improved. This allows minimization to be achieved for the above-described various defects in the fuel consumption performance and the catalyst performance, which are attributed to the excess/shortage in the estimated value of the NOx absorption amount.

A fifth aspect of the present invention is characterized in that, in the third or fourth aspect of the present invention, an exhaust gas temperature detection section is provided for detecting an exhaust gas temperature. In addition, the momentary NOx absorbable amount setting section sets the momentary NOx absorbable amount according to at least one of the exhaust gas temperature detected by the detection section and the momentary NOx supply amount set by the momentary NOx supply amount setting section.

According to the above invention (fifth aspect), the momentary NOx absorbable amount is accurately set. Specifically, as described above, the absorption capability of the NOx catalyst, that is, momentary NOx absorbable amount is significantly influenced not only by the integrated NOx absorption amount, but also by other factors, such as the exhaust gas temperature and the momentary NOx supply amount. Therefore, the value excellent in the accuracy can be obtained through setting of the momentary NOx absorbable amount according to the factors, such as the exhaust gas temperature and the momentary NOx supply amount.

As a result, when the value of the momentary NOx absorbable amount is employed as the momentary NOx absorption amount, the estimation accuracy of the momentary NOx absorption amount is improved, and in addition, the estimation accuracy of the integrated NOx absorption amount is also improved. This allows minimization to be achieved for the above-described various defects in the fuel consumption performance and the catalyst performance, which are attributed to the excess/shortage in the estimated value of the NOx absorption amount.

Hereinbelow, the present invention and other relative matters will be described in greater detail through an embodiment.

BRIEF DESCRIPTION OF THE DRAWINGS

Various characteristics and advantages of the present invention will be further described in details by the following preferred embodiments, with reference to the accompanied drawings, in which.

DETAILED DESCRIPTION OF THE PREFERRED EMBODIMENTS

This application is based on an application No. 2000-187600 filed in Japan, the content of which is herein expressly incorporated by reference in its entirety.

[System Configuration]

Figure 1:
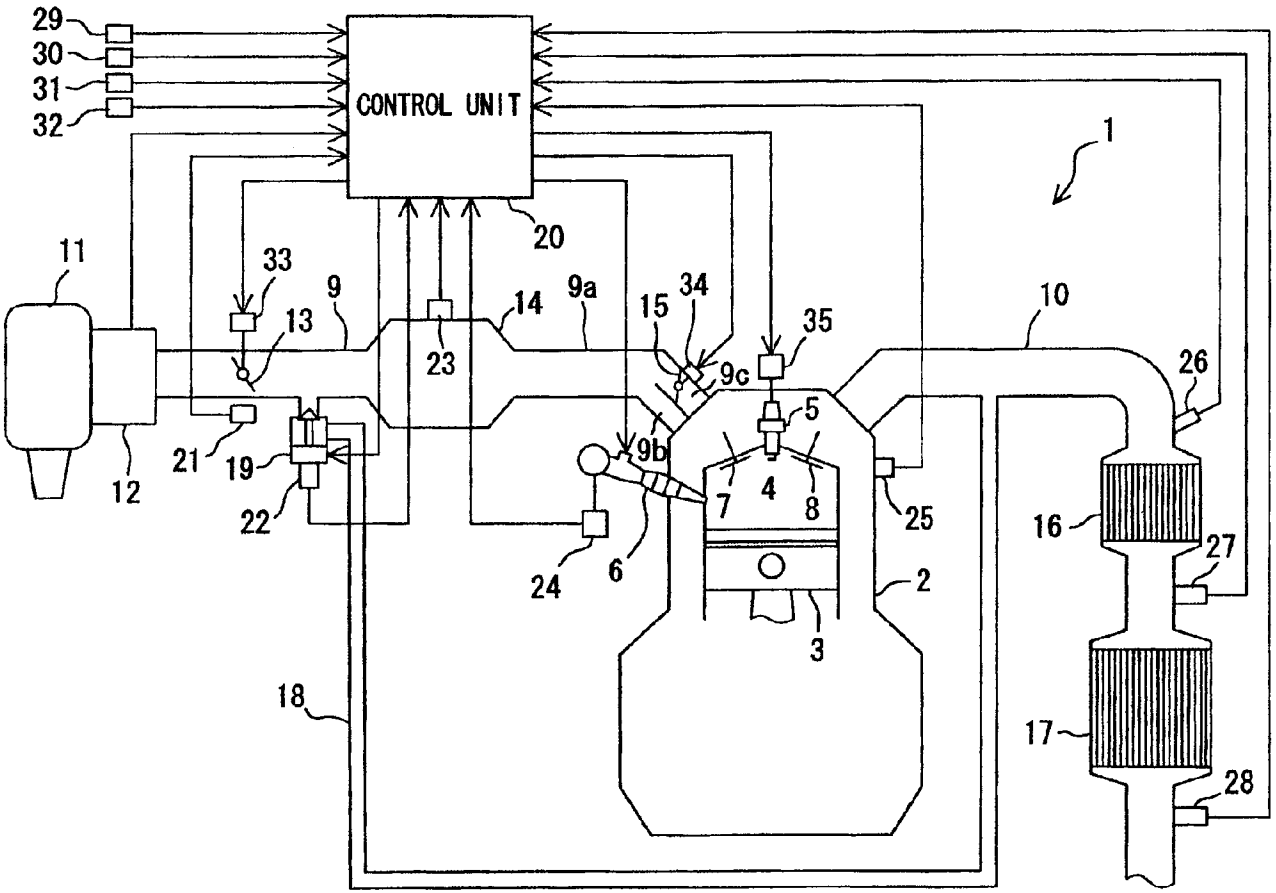
FIG. 1 is a configuration view of an engine control system according to an embodiment of the present invention.

FIG. 1 is a configuration view of a control system of a direct-injection stratified combustion engine 1 according to an embodiment. In a main assembly 2 of the engine 1, a plurality of combustion chambers 4 (one of them is depicted in the figure) each formed with a piston 3 are provided. A spark plug 5 is provided in an upper portion of the combustion chamber 4, and an injector 6 is provided in a side portion of the combustion chamber 4. The injector 6 directly injects fuel into the combustion chamber 4.

An intake passage 9 and an exhaust passage 10 are connected to the combustion chamber 4 via an intake valve 7 and an exhaust valve 8, respectively. In the order from the upstream side, an air cleaner 11, an airflow sensor 12, a throttle valve 13, and a surge tank 14 are disposed in the intake passage 9. The downstream side of the surge tank 14 is formed to branch to independent intake passages 9*a* in units of a cylinder. A downstream end portion of the individual independent intake passage 9*a* is divided into two passages 9*b* and 9*c*. A swirl generating valve 15 is provided in the passage 9*c*. When the swirl generating valve 15 is shut off, swirls are generated in the combustion chamber 4 according to intake air drawn in from the passage 9*b*.

A three-way catalyst 16 and a catalyst 17 of a NOx absorbing-and-reducing type are disposed in series in the exhaust passage 10. The three-way catalyst 16 works to simultaneously eliminate CO, HC, and NOx in exhaust gases in the vicinity of the theoretical air fuel ratio (A/F=14.7).

When the air fuel ratio is, for example, leaner than the theoretical air fuel ratio ($\lambda>1$), the catalyst 17 of the NOx absorbing-and-reducing type absorbs NOx, which was not purified by the three-way catalyst 16 and has been allowed flows inside, to thereby control the emission thereof to the outside. On the other hand, when the air fuel ratio is, for example, in the vicinity of the theoretical air fuel ratio or richer than the theoretical air fuel ratio ($\lambda\leqq1$), NOx is subjected to an oxidation reduction reaction with CO and HC in the exhaust gas and is thereby decomposed into oxygen and nitrogen. The catalyst 17 of the NOx absorbing-and-reducing type contains an NOx absorbing material (not shown) made of barium as a base and including an alkali metal, such as potassium, magnesium, strontium, lanthanum, or an alkaline earth element, or a rare earth element, and a precious metal having chemical reaction catalyzing effects.

An exhaust gas circulating passage 18 is provided between an upstream side of the three-way catalyst 16 in the exhaust passage 10 and an upstream side of the surge tank 14 in the intake passage 9. A part of an exhaust gas flowing through the exhaust passage 10 passes through the exhaust gas circulating passage 18, and is thereby controlled to circulate through the intake passage 9. An exhaust circulation amount control valve 19 for controlling an exhaust gas circulation amount is provided in the exhaust gas circulating passage 18.

A control unit 20 (ECU) of the engine 1 inputs various signals including a signal from the airflow sensor 12 that detects an intake air amount; a signal from a throttle aperture sensor 21 that detects the aperture of the throttle valve 13, a signal from a circulation amount sensor 22 that detects the aperture of the exhaust gas circulation amount control valve 19; a signal from a boost sensor 23 that detects intake reverse pressure in the surge tank 14; a signal from a fuel pressure sensor 24 that detects the pressure of fuel fed to the injector 6; a signal from a water temperature sensor 25 that detects the temperature of cooling water in the main assembly 2; a signal from a first air fuel ratio sensor 26 provided on the upstream side of the three-way catalyst 16 and formed of an $O_2$ sensor that detects according to the concentration of residual oxygen in exhaust gases exhausted from the combustion chamber 4 as to whether the air fuel ratio of a mixture fed to the combustion chamber 4 is leaner or richer than the theoretical air fuel ratio; a signal from an exhaust temperature sensor 27 provided between the three-way catalyst 16 the catalyst 17 of the NOx absorbing-and-reducing type to detect the exhaust gas temperature just before it flows into the NOx catalyst 17; a signal from a second air fuel ratio sensor 28 provided on the downstream side of the NOx catalyst 17 and formed of an $O_2$ sensor that detects the concentration of residual oxygen in the exhaust gas that has passed through the NOx catalyst 17; a signal from an engine speed sensor 29 that detects the speed of the engine 1; a signal from an accelerator aperture sensor 30 that detects the amount of stepping-on of an accelerator pedal (not shown); a signal from an intake air temperature sensor 31 that detects the temperature of intake air; and a signal from an atmospheric pressure sensor 32 that detects the atmospheric pressure.

According to the operation condition and the like of the engine 1 that are determined based on the aforementioned various signals, the control unit 20 outputs control signals to, for example, an actuator 33 for driving the throttle valve 13, the exhaust gas circulation amount control valve 19, the injector 6, an actuator 34 for driving the swirl generating valve 15, and a sparking circuit 35 for sparking the spark plug 5. Thereby, the control unit 20 totally performs control including, throttle aperture control, exhaust gas circulation control, fuel injection amount control, fuel injection timing control, swirl generation control, spark timing control, NOx emission control for NOx emitted from the NOx catalyst 17, and sulfur emission control for sulfur emitted from the NOx catalyst 17.

[Air Fuel Ratio Map]

Figure 2:
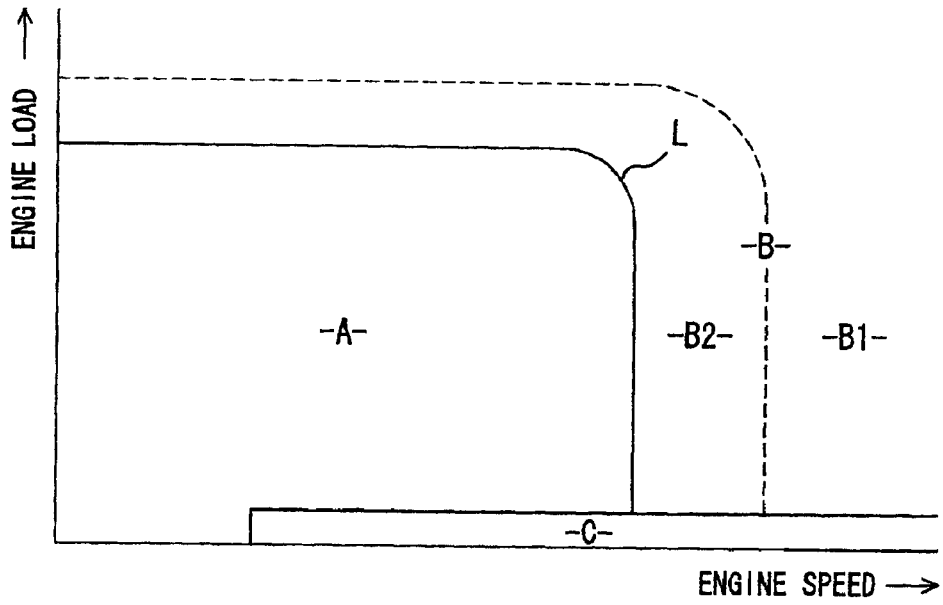
FIG. 2 is an engine air fuel ratio map.

FIG. 2 is an air fuel ratio map of the engine 1. In this map, an operation area set with parameters of the engine speed and engine load is separated into a lean operation area A, a rich operation area B1, a theoretical air fuel ratio operation area B2, and a fuel reduction area C. The NOx emission control changes a boundary L between the lean operation area A and the theoretical air fuel ratio operation area B1. The map shown FIG. 2 represents a state where no substantial NOx emission control is executed.

The lean operation area A is set to a range from a low speed to an intermediate speed, which is most frequently used, and a range from a low load to an intermediate load. In the lean operation area A, the air fuel ratio is set higher than the theoretical air fuel ratio ($\lambda>1$). In a lean operation in the lean operation area A, fuel is injected during a compression stroke (injection in a second half period). Fuel is controlled to reach the vicinity of the spark plug 5, and is stratification-combusted. In the lean operation, NOx in exhaust gas is absorbed in the NOx catalyst 17 to thereby improve fuel consumption performance and exhaustion performance.

The rich operation area B1 is set to a high speed side that is an operation area for high speed operation and accelerated operation, and concurrently, is set to a high load side. In the area B, the air fuel ratio is set lower than the theoretical air fuel ratio ($\lambda<1$). In the rich operation in the area B, fuel is injected during an intake stroke (injection in a first-half period), and the fuel is sufficiently gasified in the combustion chamber 4. In the rich operation, an oxidation reduction reaction takes place between NOx absorbed in the NOx catalyst 17 and CO and HC, thereby allowing suitable torque to be obtained, and further allowing the exhaustion performance to be improved.

The theoretical air fuel ratio operation area B2 is set to an area between the lean operation area A and the rich operation area B1. In the area C, the air fuel ratio is set to the theoretical air fuel ratio ($\lambda=1$). Similarly to the case in the rich operation, in the theoretical air fuel ratio operation in the area C, fuel is injected during an intake stroke (injection in a first-half period), and is sufficiently gasified in the combustion chamber 4. In the theoretical air fuel ratio operation, CO, HC, and NOx in the exhaust gas are simultaneously purified by the three-way catalyst 16.

The fuel reduction area C is set to a range from an intermediate speed to a high speed, and to a low load side. In the case of the area C, fuel injection to the combustion chamber 4 is stopped.

[NOx Emission Control]

Basically, when the amount of NOx absorbed in the NOx catalyst 17 is increased according to a continued lean operation in the lean operation area A, the NOx emission control controls the air fuel ratio to be richer than at least the air fuel ratio in the lean operation (for example, it controls the ratio to be the theoretical air fuel ratio or to be higher than that). Thereby, the NOx emission control controls NOx to be decomposed into oxygen and nitrogen so as to be emitted, thereby allowing recovery in the absorption capability of the NOx catalyst 17.

In the above case, when the NOx absorption amount is equal to or greater than a predetermined amount, the control may be performed such that, regardless of the operation condition at this time, the air fuel ratio immediately is enriched for a predetermined period of time, and absorbed NOx is completely emitted. This method is implemented in a way that, for example, in the above-described air fuel ratio map, the overall operation area is controlled to be in either the rich operation area B1 or in the theoretical air fuel ratio operation area B2 (hereinbelow, the two areas B1 and B2 together will be referred to as a "enrichment operation area B").

According to the present embodiment, the NOx emission control is implemented such that the lean operation area A decreases as the increase in the NOx absorption amount increases to thereby enlarge the enrichment operation area B. Specifically, when the operation condition is in the lean operation area A, the probability that the NOx emission processing starts increases in proportion to the increase in the NOx absorption amount; and conversely, the probability that the NOx emission processing starts decreases in proportion to the reduction in the NOx absorption amount. On the other hand, when the operation condition is in the enrichment operation area B, the probability that the NOx emission processing terminates decreases in adverse proportion to the increase in the NOx absorption amount; and conversely, the probability that the NOx emission processing terminates increases in adverse proportion to the reduction in the NOx absorption amount.

Figure 3:
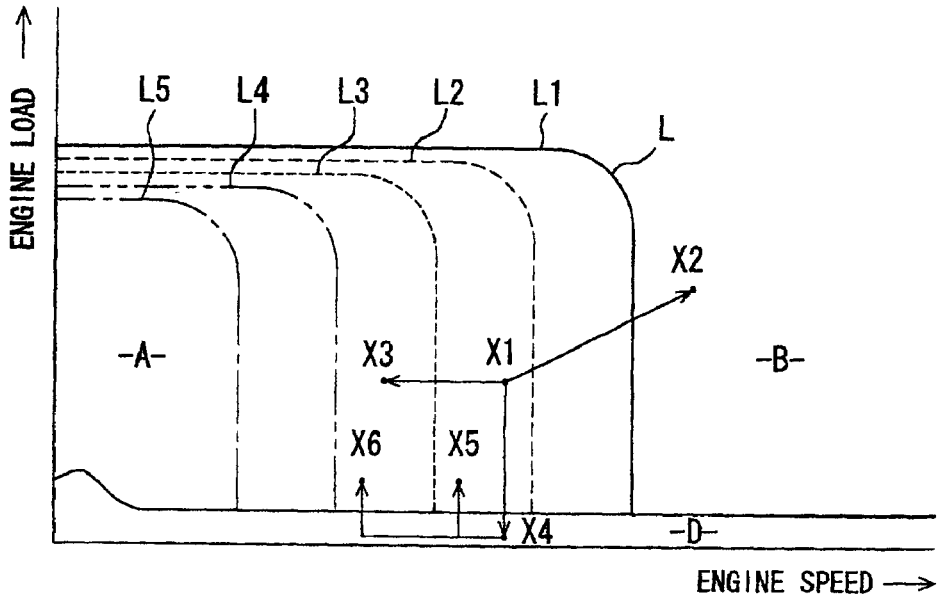
FIG. 3 is a view showing a mode in which individual areas vary in the air fuel ratio map.

The above will be described below in detail with reference to FIG. 3. Suppose the operation condition is maintained in a condition shown with symbol X1. The operation condition X1 is in the lean operation area A in the normal time air fuel ratio map shown in FIG. 2. In FIG. 3, a solid line L1 represents a boundary between the lean operation area A and the enrichment operation area B in the normal time air fuel ratio map.

When the NOx absorption amount increases, as shown by a broken line L2, the boundary between the lean operation area A and the enrichment operation area B is shifted to the low load side as well as to the low speed side. This causes the lean operation area A to be reduced, and causes the enrichment operation area B to be enlarged. In the illustrated example, however, since the operation condition X1 remains in the lean operation area A, the NOx emission processing does not start.

When the NOx absorption amount further increases, as shown by a dotted line L3, the boundary between the lean operation area A and the enrichment operation area B is further shifted to the low load side as well as to the low speed side. Thereby, the lean operation area A is further reduced, and the enrichment operation area B is further enlarged. In the illustrated example, the operation condition X1 belongs to the enrichment operation area B, and the NOx emission processing is started.

When the NOx emission processing is started, the amount of the NOx component to be emitted from the catalyst 17 according to the enriched air fuel ratio is estimated, and the residual NOx absorption amount is estimated. When the residual NOx absorption amount is reduced to zero, that is, when the amount of NOx emitted by the NOx emission processing is reached to the NOx absorption amount in the state where the NOx emission processing is started, the boundary between the lean operation area A and the enrichment operation area B is controlled to return to the normal time position shown by the solid line L1. Thereby, the operation condition X1 is controlled to belong to the lean operation area A again, and the NOx emission processing terminates.

In the described way, the method for gradually reducing the lean operation area A in the air fuel ratio map and for gradually enlarging the enrichment operation area B is superior in fuel consumption performance to the method for abruptly controlling the overall operation area to become the enrichment operation area B.

Figure 4:
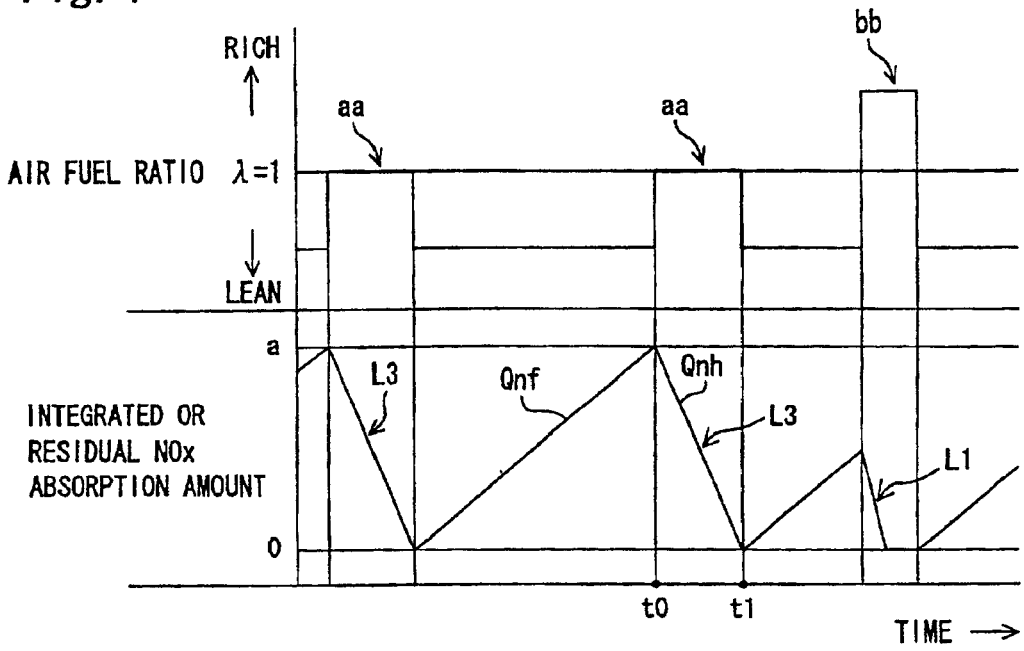
FIG. 4 is a timing chart in an example of NOx emission control.

FIG. 4 is a timing chart representing timing in the case where the above-described typical NOx emission control is performed. In a period in which the NOx absorption amount increases during the lean operation, the NOx absorption amount is represented by an integrated NOx absorption amount (Qnf); while in a period of enrichment shown by symbol aa (during NOx emission processing), it is represented by a residual NOx absorption amount (Qnh). The NOx emission processing is executed in the period from a time t0 to a time t1. The example shows that when the integrated NOx absorption amount (Qnf) increases to a level "a", the enrichment operation area B is enlarged up to the boundary L3. According to the enrichment operation area B thus enlarged to L3, the NOx emission processing is implemented.

Enrichment represented by symbol bb is not achieved by the NOx emission control, but is achieved through, for example, an accelerating operation performed by a vehicle driver. Specifically, FIG. 3 shows a state in which the vehicle driver desires acceleration and steps on an accelerator pedal; and when the operation condition is thereby shifted from X1 to X2, since the operation condition X2 belongs to the normal time enrichment operation area B formed with L1; therefore, even before the integrated NOx absorption amount (Qnf) is increased to the level of "a", NOx is emitted according to the normal time enrichment operation area B formed with the normal time L1.

As shown in FIG. 3, the boundary L between the lean operation area A and the enrichment operation area B is not shifted at a level equivalent to that of the engine load and the engine speed. The boundary L is shifted in a low rate with respect to the engine load, while it is shifted at a high rate with respect to the engine speed. Consequently, the lean operation area A is reduced at a low rate with respect to the engine load, and is reduced at a high rate with respect to the engine speed. Also, the enrichment operation area B is enlarged at a low rate with respect to the engine load, and is enlarged at a high rate with respect to the engine speed.

To increase the frequency in execution of the NOx emission processing, if the lean operation area A is reduced, and the enrichment operation area B is enlarged, shifting may be controlled in other ways. For example, the boundary L may be controlled to shift at an equivalent rate with respect to the engine load and the engine speed; or conversely, the shift rate with respect to the engine load may be controlled higher than the rate with respect to the engine speed.

However, according to the embodiment of the present invention, the boundary L is changed at a priority higher with respect to the engine speed than that with respect to the engine load. Consequently, the ratio at which a high speed area is shifted to the enrichment operation area B is higher than that at which it is shifted to the lean operation area A. This is attributed to the fact that the exhaust gas temperature is increased in the areas of higher speeds; and as the temperature of the NOx catalyst 17 increases, the purification function of the catalyst 17 is degraded during the lean operation. In specific, when a high speed area is maintained as the lean operation area A, the purification function of the catalyst 17 is degraded; therefore, the high speed area is shifted to the enrichment operation area B at a high frequency. Thereby, occurrence of defects can be minimized; that is, a preferable result can be obtained.

For example, as described below, when the exhaust gas temperature increases, and the temperature of the NOx catalyst 17 is thereby increased, reduction occurs in a selective reduction purification ratio $\alpha$ of the NOx component to be selectively reduced by the catalyst 17 (refer to FIG. 17). In addition, reduction occurs in a NOx absorbable amount (Qnd), which represents the amount of NOx that can be absorbed in the catalyst 17 on the basis of a unit time in the lean condition, that is, a NOx absorption speed (refer to FIG. 20).

Therefore, the engine load along the boundary L may be controlled not to vary, and only the engine speed may be controlled to shift to the low speed side. Furthermore, the engine speed may be controlled to shift to the low speed side; and as a result, the engine load value may be increased since it is not problematic as long as the lean operation area A is reduced.

Preferably, the boundary L between the lean operation area A and the enrichment operation area B is determined according to the NOx absorption amount and the exhaust gas temperature. For example, according to a map shown in FIG. 5, as the integrated NOx absorption amount (Qnf) increases, the lean operation area A is reduced, and concurrently, the enrichment operation area B is enlarged. In addition, as the exhaust gas temperature (Tmp) increases, the lean operation area A is reduced, and concurrently, the enrichment operation area B is enlarged. The reason for the above is that, similarly to the above, as the exhaust gas temperature increases causing the temperature of the NOx catalyst 17 to increase, the purification function of the catalyst 17 in the lean condition is degraded. Therefore, when the exhaust gas temperature is high, the lean operation area A is reduced to minimize errors.

According to the above, when the operation condition is in, for example, the high speed area, or when the exhaust gas temperature is high, the air fuel ratio is enriched with early timing for NOx emission processing. Alternatively, when the operation condition is in, for example, the low speed area, or when the exhaust gas temperature is low, the air fuel ratio is enriched with late timing for NOx emission processing. In the above, when the operation condition continues and stays in the same speed area for a relatively long time, or when the exhaust gas temperature continues and stays at the same temperature for a relatively long time, the temperature of the NOx catalyst 17 is apparently stable at the same temperature. Therefore, although the exhaust gas temperature Tmp detected by the exhaust temperature sensor 27 can be substituted for the temperature of the NOx catalyst 17. However, when the operation condition does not continue and does not stay in the same speed area for a long time, or when the exhaust gas temperature does not continue and stay at the same temperature for a long time since the temperature of the NOx catalyst 17 is not always 5 stable at the same temperature, a temperature estimated from the exhaust gas temperature Tmp is preferably used for the temperature of the NOx catalyst 17.

Figure 6:
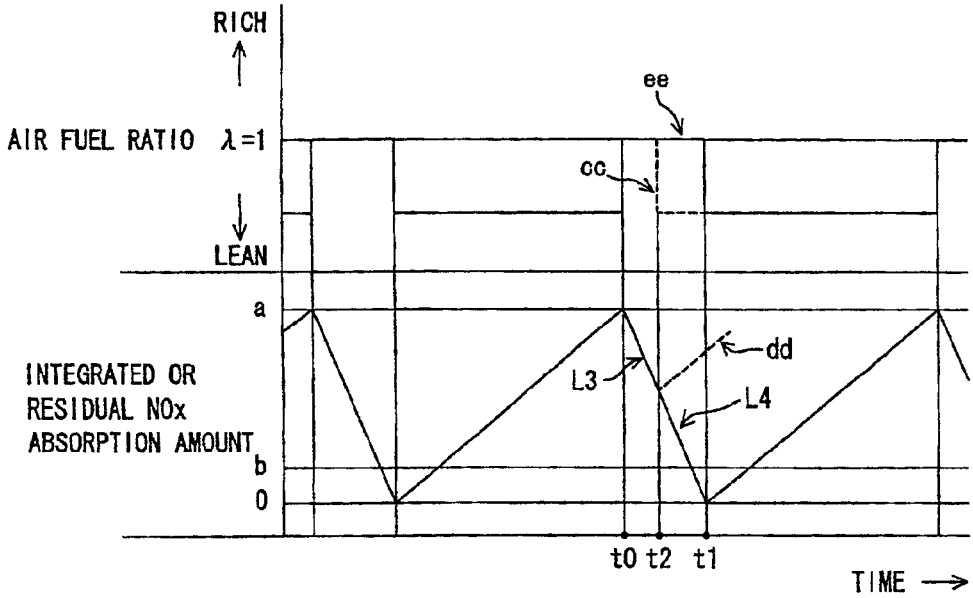
FIG. 6 is a timing chart in another example of NOx emission control.
Figure 7:
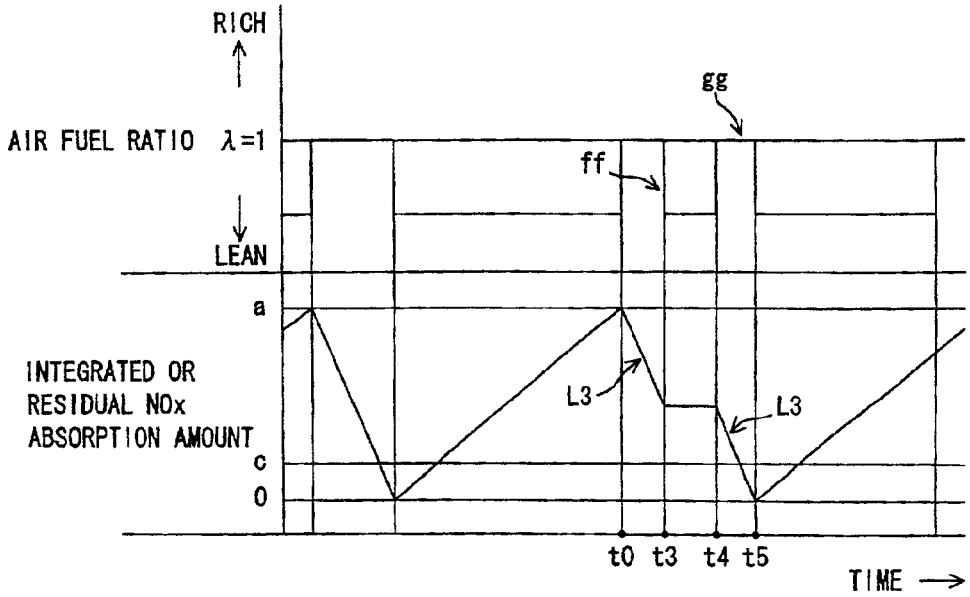
FIG. 7 is a timing chart in still another example of NOx emission control.
Figure 8:
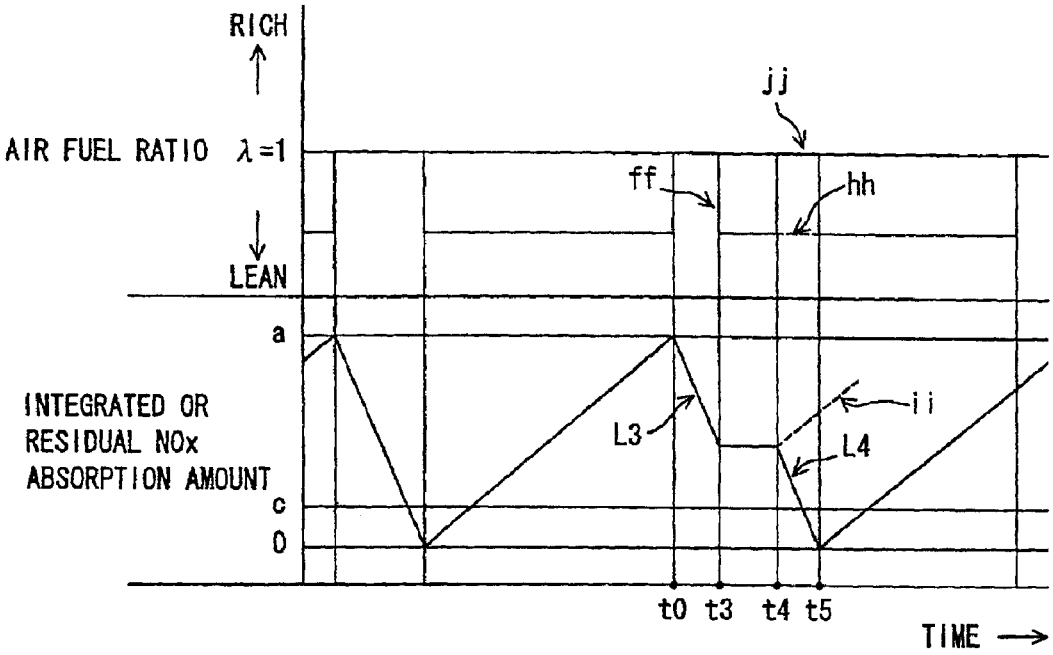
FIG. 8 is a timing chart in still another example of NOx emission control.

The NOx emission control shown in FIG. 4 is the typical example in which the operation condition is maintained at X1. However, a case can occur in which the speed is reduced in the NOx emission processing according to a driver's accelerator-returning operation, a hill-climbing grade, thereby resulting in that, as shown by symbol X3 in FIG. 3, the operation condition X1 deviates from the enrichment operation area B to the lean operation area A. In addition, a case can occur in which according to abrupt accelerator-returning operation performed by a driver, the operation condition X1 deviates from the enrichment operation area B to a NOx emission processing nonexecution area D as shown by symbol X4 in FIG. 3. A timing chart in the former case is shown in FIG. 6, and a timing chart in the latter case is shown in FIGS. 7 and 8.

In principle, in the former case, since an operation condition X3 belongs to the lean operation area A, the NOx emission processing is discontinued. In the present embodiment, however, the countermeasure depends on a residual NOx absorption amount (Qnh) at the time when the operation condition deviates from the enrichment operation area B.

Specifically, as shown by a dotted line cc, when the operation condition deviates from the enrichment operation area B at a time t2, and the NOx emission processing is thereby suspended, an integrated NOx absorption amount (Qnf) increases again, as shown by a dotted line dd. As a matter of course, when the integrated NOx absorption amount (Qnf) exceeds "a" and further increases, a subsequent boundary L4 in the direction of load lower than the level of the boundary L3 and in the direction of speed lower than the level of the boundary L3 is set, and from that time on, the NOx emission processing is restarted according to the enrichment operation area B enlarged up to L4. In the meantime, however, an idle time occurs in the NOx emission processing. In this case, since the processing efficiency is reduced, and in addition, a lean operation is executed while significant part of the NOx absorption amount (Qnf) still remains, the case described above is not preferable in terms of the purification performance of the catalyst 17.

In view of the above, when the residual NOx absorption amount (Qnh) at the time when the operation condition deviates from the enrichment operation area B is equal to or greater than a predetermined amount "b", the NOx emission processing is not suspended and continued. To achieve this, the boundary L is immediately reset so that, for example, the operation condition X3 is included in the enrichment operation area B. Thereby, as shown by symbol ee in FIG. 6, the enrichment of the air fuel ratio is maintained. The illustrated example shows a state where at the time t2 and thereafter, according to the enrichment operation area B enlarged up to L4, the NOx emission processing is continued without an idle time occurred. In this case, the NOx emission processing is efficiently completed with a result that is preferable in terms of the catalyst purification performance.

When the residual NOx absorption amount (Qnh) at the time when the operation condition deviates from the enrichment operation area B is equal to or less than a predetermined amount "b", the NOx emission processing simply discontinues. Since the NOx absorption amount (Qnf) is already small, the purification performance of the catalyst 17 is already recovered, and defects are reduced when lean operation is executed. It is more advantageous that excellent fuel consumption performance is ensured according to the lean operation. At this time, the boundary between the lean operation area A and the enrichment operation area B will have been returned to one of the position along L2 and the normal time position along L1 according to, for example, the residual NOx absorption amount (Qnh).

In the latter case, since the operation condition X4 belongs to the NOx emission processing nonexecution area D, the NOx emission processing is unconditionally suspended. However, thereafter, as shown by symbol X5 in FIG. 3, regardless of the case where the operation condition X4 passes out to the enrichment operation area B, when the operation condition X4 passes over to the lean operation area A, as shown by symbol X6, the countermeasure differs depending on the residual NOx absorption amount (Qnh).

The NOx emission processing nonexecution area D is a combination of the fuel reduction area C and an area in the direction of speed lower than that of the fuel reduction area C. In the area D, since the supply amount of fuel is extremely small, the integrated NOx absorption amount (Qnf) almost does not increase. It is difficult to enrich the air fuel ratio in the area D; and when enrichment is carried out therein, many unburned components of the fuel remain, thereby causing an unstable operation condition of the engine 1.

As shown by symbol ff in FIG. 7, the operation condition shifts to the NOx emission processing nonexecution area D at a time t3, and the NOx emission processing discontinues. The integrated NOx absorption amount (Qnf) shifts almost as it is. In this period, the boundary L is either maintained as L3 or returned to L2 according to, for example, the residual NOx absorption amount (Qnh) at the time t3.

As shown by symbol gg, upon shifting of the operation condition at a time t4 to the enrichment operation area B, the NOx emission processing starts again. In the example shows that, also after the time t4, the NOx emission processing is restarted according to the enrichment operation area B formed with the boundary L3. In this way, after the operational discontinuation in nonexecution area D, when the operation condition has shifted to the enrichment operation area B, the continuation part of the NOx emission processing is performed regardless of the residual NOx absorption amount (Qnh).

However, a problem arises when the operation condition has shifted to the lean operation area A after the operational discontinuation in nonexecution area D. Specifically, as shown by a dotted line hh in FIG. 8, when the operation condition shifts at the time t4 to the lean operation area A, the integrated NOx absorption amount (Qnf) increases again from the time t4 on, as shown by a dotted line ii. As a matter of course, when the integrated NOx absorption amount (Qnf) passes over "a" and further increases, the subsequent boundary L4 in the direction of load lower than the level of the boundary L3 and in the direction of speed lower than the level of the boundary L3 is set, and from that time on, the NOx emission processing is restarted according to the enrichment operation area B enlarged up to L4. In the meantime, however, an idle time occurs in the NOx emission processing. In this case, since the processing efficiency is reduced, and in addition, a lean operation is executed while a large portion of the NOx absorption amount (Qnf) still remains. This case is not preferable in terms of the purification performance of the catalyst 17.

In view of the above, when the integrated NOx absorption amount (Qnf) at the time when the operation condition shifts to the lean operation area A is equal to or greater than a predetermined amount "c", the NOx emission processing is immediately restarted. To achieve this, the boundary L is immediately reset so that, for example, an operation condition X6 shown in FIG. 3 is included in the enrichment operation area B. Thereby, as shown by symbol jj in FIG. 8, the air fuel ratio is enriched. The illustrated example shows a state where at the time t4 and thereafter, according to the enrichment operation area B enlarged up to L4, the NOx emission processing is restarted. In this case, the NOx emission processing is efficiently completed with a result that is preferable in terms of the catalyst purification performance.

When the integrated NOx absorption amount (Qnf) at the time when the operation condition shifts to the lean operation area A is equal to or smaller than a predetermined amount "c", the NOx emission processing does not restart. Since the NOx absorption amount (Qnf) is already small, the purification performance of the catalyst 17 is already recovered, and defects are few when lean operation is executed. It is more advantageous that excellent fuel consumption performance is ensured according to the lean operation. At this time, the boundary between the lean operation area A and the enrichment operation area B will have been either maintained along L2 or returned to L1 according to, for example, the integrated NOx absorption amount (Qnf) at a time t3.

Figure 9:
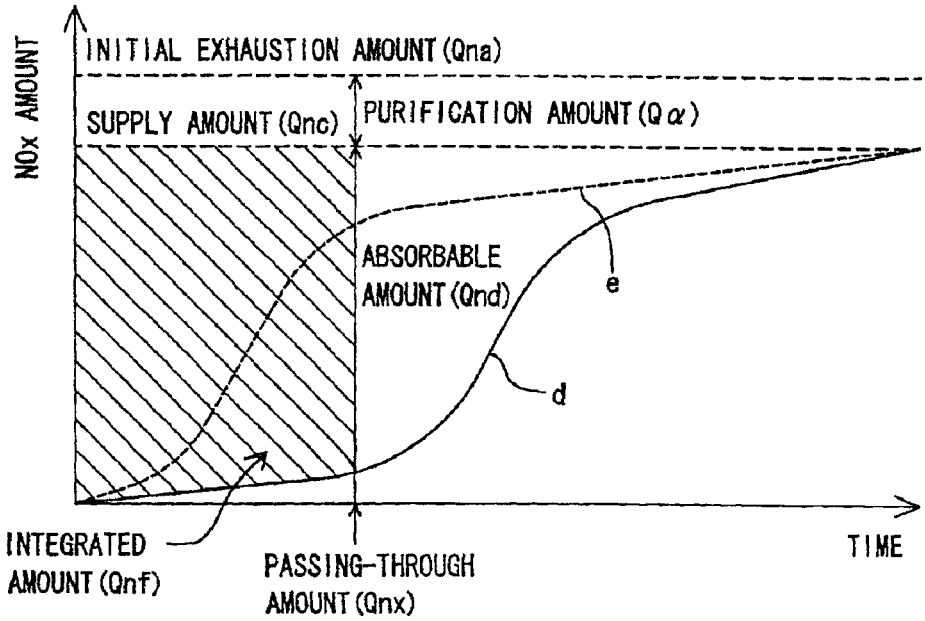
FIG. 9 is a timing chart relative to a NOx pass-through amount.

As shown in FIG. 9, in the lean operation, the NOx absorbable amount (Qnd), which is the amount of NOx absorbable in the NOx catalyst 17 on the basis of a unit time, and a NOx passing-through amount (Qnx) increases. The NOx passing-through amount (Qnx) is the amount of NOx that cannot be absorbed by the NOx catalyst 17 and that is allowed to pass therethrough. The amount of NOx in the exhaust gas exhausted from each of the combustion chambers 4, . . . , and 4 to the exhaust passage 10 is represented by a NOx initial exhaustion amount (Qna). The NOx catalyst 17 is a selectively reducing type that reduces and purifies a NOx component even in a lean condition. When the purification ratio is represented by "α", and the purification amount is represented "Qα", the value of the NOx supply amount (Qnc) representing the amount of NOx to be supplied to the catalyst 17 is obtained by subtracting the NOx purification amount (Qα) from the NOx initial exhaustion amount (Qna). The value representing the remainder of the subtraction of the NOx absorbable amount (Qnd) from the NOx supply amount (Qnc) is therefore used as the value of the NOx passing-through amount (Qnx).

In FIG. 9, line curves shown by symbols d and e represent time variations in the NOx passing-through amount (Qnx). Symbol d denotes the line curve when the exhaust gas temperature (Tmp) is low, while symbol e represents the line curve when the exhaust gas temperature (Tmp) is high. The integrated NOx absorption amount (Qnf) is represented by an area surrounded by the line curves d and e up to the current time and a line representing the NOx supply amount (Qnc). In FIG. 9, an example of the low case (d) where the exhaust gas is low is shown by hatched lines.

Compared to the high case (e), in the low case (d) momentary NOx absorbable (Qnd) is maintained larger for a long time; therefore, the NOx passing-through amount (Qnx) is maintained less for a long time. That is, the purification capability of the NOx catalyst 17 is maintained at a high level for a long time. Concurrently, compared to the purification capability of the NOx catalyst 17 in the high case (e), integrated NOx absorption amount (Qnf) is higher in the low case (d). However, the purification capability of the catalyst 17 is higher. When the commencement of the NOx emission processing is determined only according to the integrated NOx absorption amount (Qnf), the NOx emission processing is early executed with a catalyst 17 having a high purification capability, while the NOx emission processing is not quickly executed with a NOx catalyst 17 having a low purification capability. Thus, the processing lacks rationality In view of the above, regardless of the determination conditions, the NOx emission processing is preferably controlled to start also in the case where the momentary NOx absorbable amount (Qnd) is reduced equal to or less than a predetermined amount, and the NOx passing-through amount (Qnx) is increase equal to or greater than an predetermined amount, in addition to the case where the integrated NOx absorption amount (Qnf) is increased equal to or greater than a predetermined amount. This securely prevents the increase in the amount of NOx to be emitted in the atmosphere through the NOx catalyst 17.

In addition, the momentary NOx absorbable amount (Qnd) is reduced in adverse proportion to the increase in the integrated NOx absorption amount (Qnf). In specific, the integrated NOx absorption amount (Qnf) is such that the greater the value of itself, the less an increment amount in units of time. Therefore, when the above tendency is taken into account, and the integrated NOx absorption amount (Qnf) is estimated, the estimation accuracy can be improved.

Figure 10:
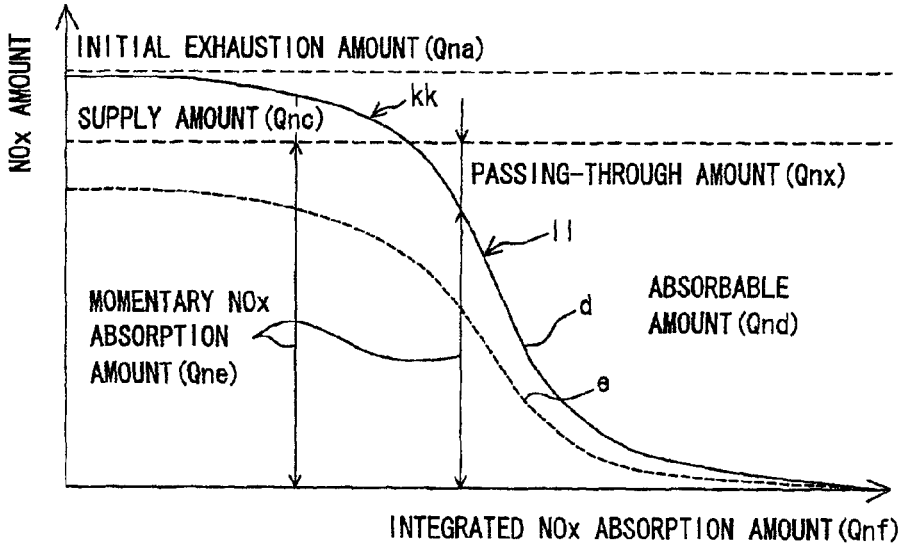
FIG. 10 is a characteristic view regarding an absorbable amount with respect to an integrated NOx absorption amount.

FIG. 10 shows variations in the momentary NOx absorbable amount (Qnd) with respect to variations in the integrated NOx absorption amount (Qnf). As described above, the momentary NOx absorbable amount (Qnd) is reduced as the integrated NOx absorption amount (Qnf) increases. An essential factor is that the momentary NOx absorbable amount (Qnd) is not a momentary NOx absorption amount (Qne) at all times. Substantially, the integrated NOx absorption amount (Qnf) takes a value obtained through the integration of momentary NOx absorption amounts (Qne).

As shown by symbol kk, when the momentary NOx absorbable amount (Qnd) is greater than the NOx supply amount (Qnc), since the NOx supply amount (Qnc) is completely absorbed by the NOx catalyst 17, the momentary NOx absorption amount (Qne) takes the value of the NOx supply amount (Qnc). In contrast, as shown by symbol 11, when the momentary NOx supply amount (Qnc) is greater than the momentary NOx absorbable amount (Qnd), since the momentary NOx supply amount (Qnc) is not completely absorbed by the NOx catalyst 17 and partly passes therethrough, the momentary NOx absorption amount (Qne) takes the value of the momentary NOx absorbable amount (Qnd).

Accordingly, momentary the NOx supply amount (Qnc) and the momentary NOx absorbable amount (Qnd) are compared with each other, and smaller one of the values is employed as the momentary NOx absorption amount (Qne). Thereby, the momentary NOx absorption amount (Qne) is rationally estimated, resulting in the improvement in the estimation accuracy of the integrated NOx absorption amount (Qnf). When the momentary NOx absorbable amount (Qnd) is employed as a value of the momentary NOx absorption amount (Qne), the momentary NOx absorption amount (Qne) is reduced in adverse proportion to the increase in the integrated NOx absorption amount (Qnf).

In addition, the momentary NOx absorbable amount (Qnd) is subjected to corrections that are performed according to various factors, including the integrated NOx absorption amount (Qnf), the exhaust gas temperature as well as the temperature of the catalyst 17, and the NOx supply amount (Qnc). As described above, for the NOx supply amount (Qnc), the NOx initial exhaustion amount (Qna) of NOx initially exhausted from the combustion chambers 4, . . . , and 4 to the exhaust passage 10 is not employed as it is; however, it is set to a value obtained through the subtraction of the amount (Qα) of NOx, which is selectively reduced and purified before absorbed by the catalyst 17, from the NOx initial exhaustion amount (Qna).

Accordingly, the momentary NOx absorbable amount (Qnd) and the momentary NOx supply amount (Qnc) are accurately set. As a result, the momentary NOx absorption amount (Qne) is accurately estimated, and in addition, the estimation accuracy of the integrated NOx absorption amount (Qnf) is thereby improved.

Figure 11:
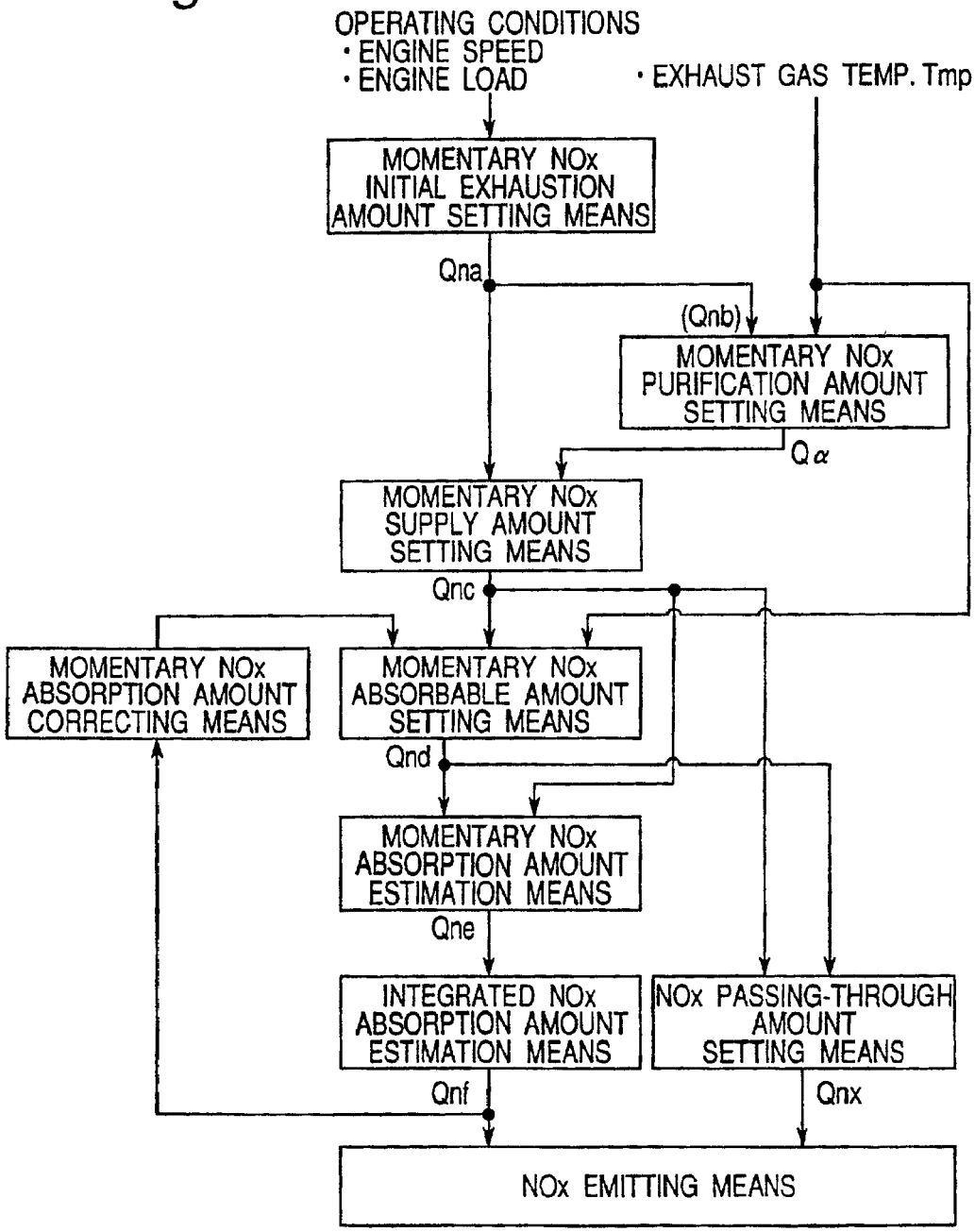
FIG. 11 is a block diagram showing flows of various signals.

Hereinbelow, an example of practical operation for implementing the above-described NOx emission control will be described referring to flowcharts. First, referring to FIG. 11, according to overview of flows of various signals, the momentary NOx initial exhaustion amount (Qna) is set by a momentary NOx initial exhaustion amount setting means (section) according to the engine speed detected by the engine revolution sensor 29 and the engine load detected by a throttle aperture sensor 21. Subsequently, the momentary NOx purification amount (Qα) is set by a momentary NOx purification setting means according to a momentary NOx initial exhaustion concentration (Qnb), which can be obtained from the initial exhaustion amount (Qna), and an exhaust gas temperature (Tmp) detected by the exhaust temperature sensor 27. The momentary NOx supply amount (Qnc) is set by a momentary NOx supply amount setting means according to the NOx purification amount (Qα) and the initial exhaustion amount (Qna). Then, the momentary NOx absorbable amount (Qnd) is set by a momentary NOx absorbable amount setting means according to the NOx supply amount (Qnc), the exhaust gas temperature (Tmp), and the integrated NOx absorption amount (Qnf) set by a momentary NOx absorption amount correcting means.

A momentary NOx absorption amount estimation means compares the NOx absorbable amount (Qnd) and the NOx supply amount (Qnc), and determines smaller one of the values to be the momentary NOx absorption amount (Qne). An integrated NOx absorption amount estimation means integrates the momentary NOx absorption amounts (Qne) and determines a value thereby obtained to be set to the integrated NOx absorption amount (Qnf). On the other hand, a NOx passing-through amount setting means sets the momentary NOx passing-through amount (Qnx) according to the NOx supply amount (Qnc) and the NOx absorbable amount (Qnd). In one of the cases where the integrated NOx absorption amount (Qnf) is equal to or greater than a predetermined amount or where the momentary NOx passing-through amount (Qnx) is equal to or greater than a predetermined amount, a NOx emitting means shifts the boundary L between the lean operation area A and the enrichment operation area B in the air fuel ratio map to at least a low speed side, and thereby executes the NOx emission processing.

Basically, a program shown in FIGS. 12 to 16 for the NOx emission control is executed continually during the operation of the engine 1 and repeatedly at a predetermined cycle. In the flowchart, processing starts in a lean operation condition. First, at step S1 in FIG. 12, the program reads individual signals; and at step S2, estimates an integrated NOx absorption amount (Qnf). Specifically, at step S31 shown in FIG. 15, the program sets the NOx initial exhaustion amount (Qna) according to the engine speed and the engine load. The greater the engine speed and the engine load, the NOx initial exhaustion amount (Qna) is set to a greater value.

Subsequently, at step S32, the selective reduction purification ratio α is set according to the exhaust gas temperature (Tmp) and the NOx initial exhaustion concentration (Qnb). As shown in FIG. 17, the higher the exhaust gas temperature (Tmp), the selective reduction purification ratio α is set to a lower value; and as shown in FIG. 18, the higher the NOx initial exhaustion concentration (Qnb), the selective reduction purification ratio α is set to a higher value.

Figure 17:
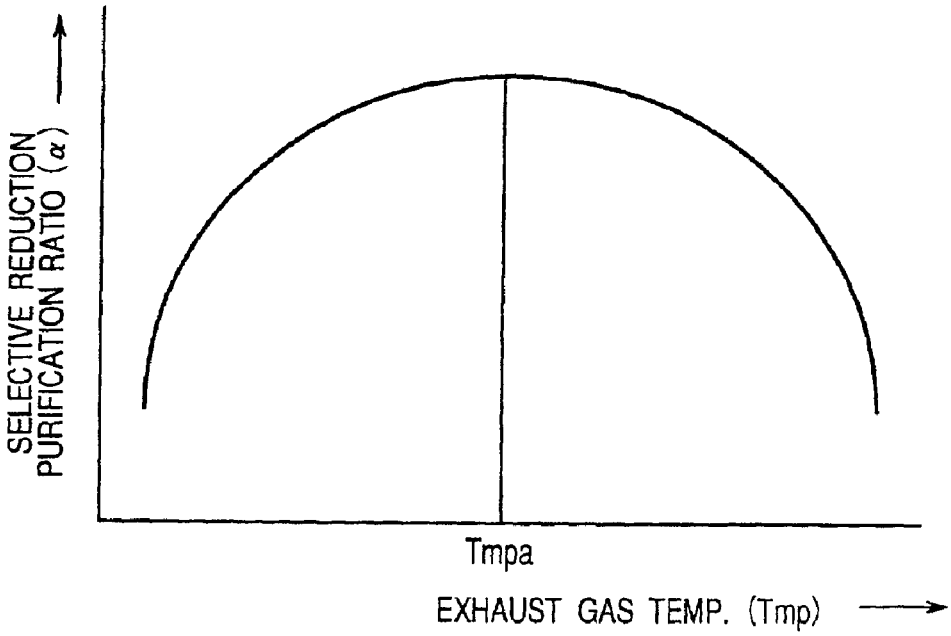
FIG. 17 is a view of characteristics used in the NOx emission control.
Figure 18:
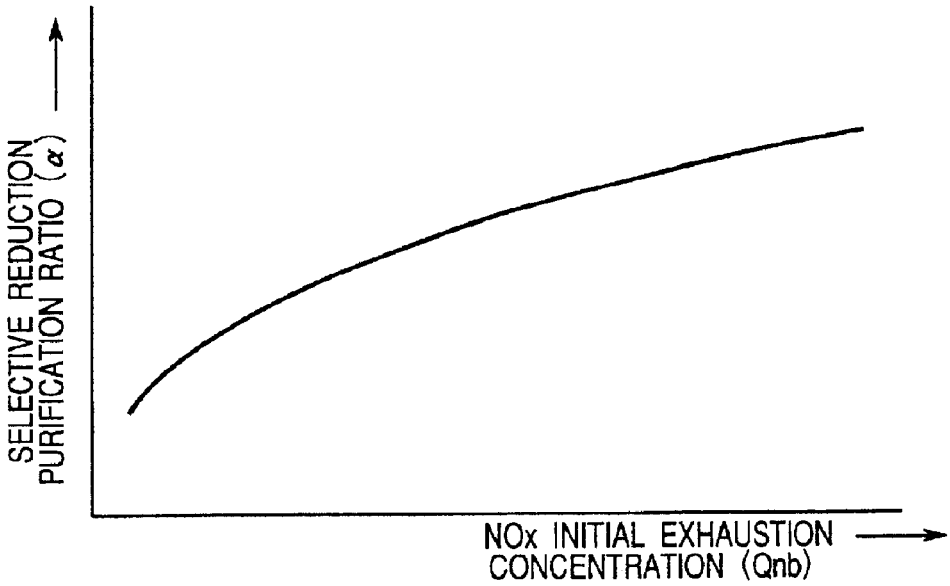
FIG. 18 is a view of characteristics.

In FIG. 17, the selective reduction purification ratio α is shown as a value that decreases when an exhaust gas temperature (Tmpa) either decreases or increases from a peak value thereof. A temperature lower than the aforementioned temperature (Tmpa) is only realized at a time, for example, immediately after the engine starts. During normal operation of the engine 1, the exhaust gas temperature is higher than the aforementioned temperature (Tmpa). Therefore, it can substantially be defined that, during normal operation of the engine 1, the higher the exhaust gas temperature (Tmp), the lower the selective reduction purification ratio α. This is true also in a case shown in FIG. 20, which will be described below.

Subsequently, at step 33, the NOx supply amount (Qnc) is set according to the NOx initial exhaustion amount (Qna) and the selective reduction purification ratio α. For example, the NOx supply amount (Qnc) is obtained through an Expression 1.

$$Qnc = Qna \times (1-\alpha) \quad \text{[Expression 1]}$$

In this case, (Qna×α) represents the selection reduction purification amount (Qα).

Figure 19:
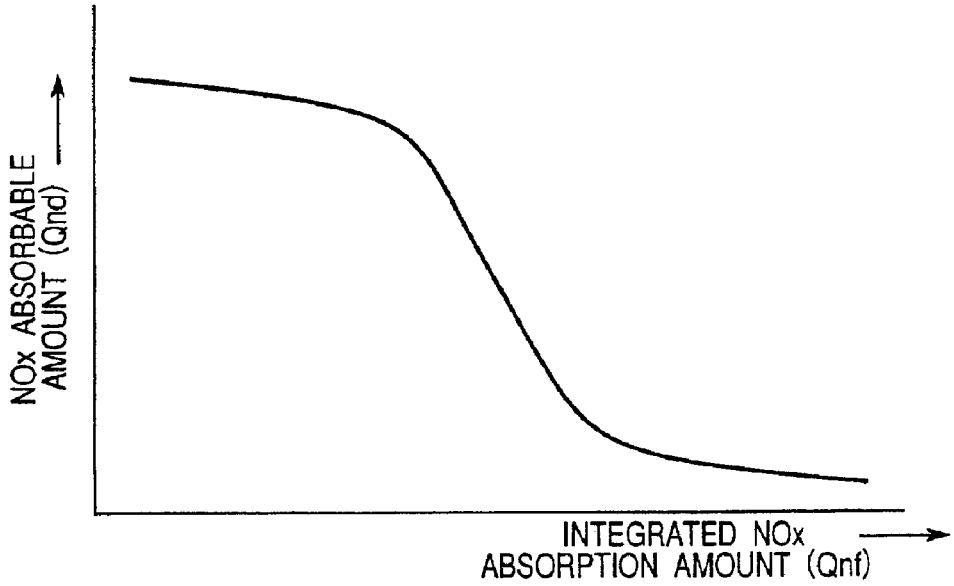
FIG. 19 is a view of characteristics.
Figure 20:
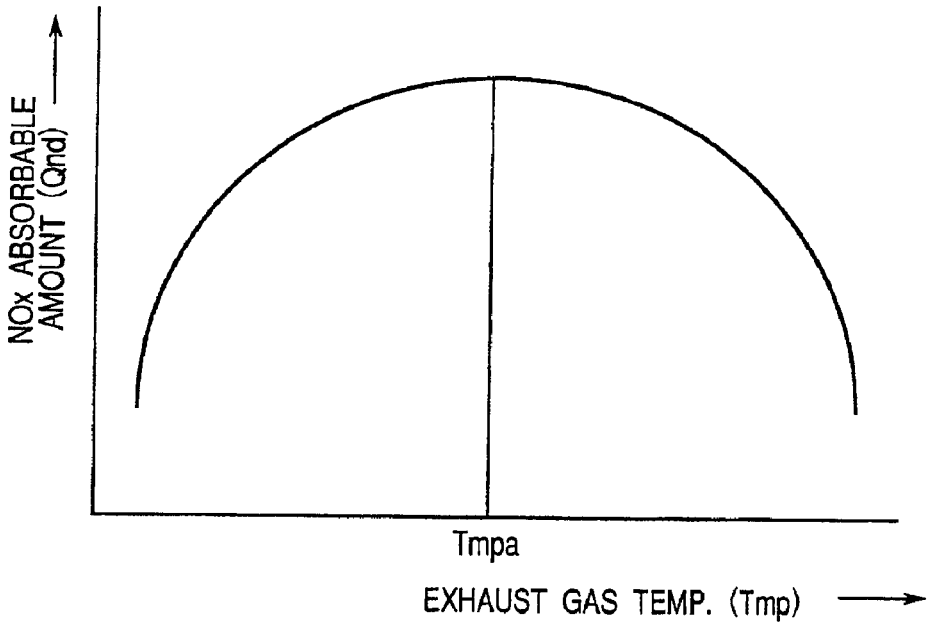
FIG. 20 is a view of characteristics.
Figure 21:
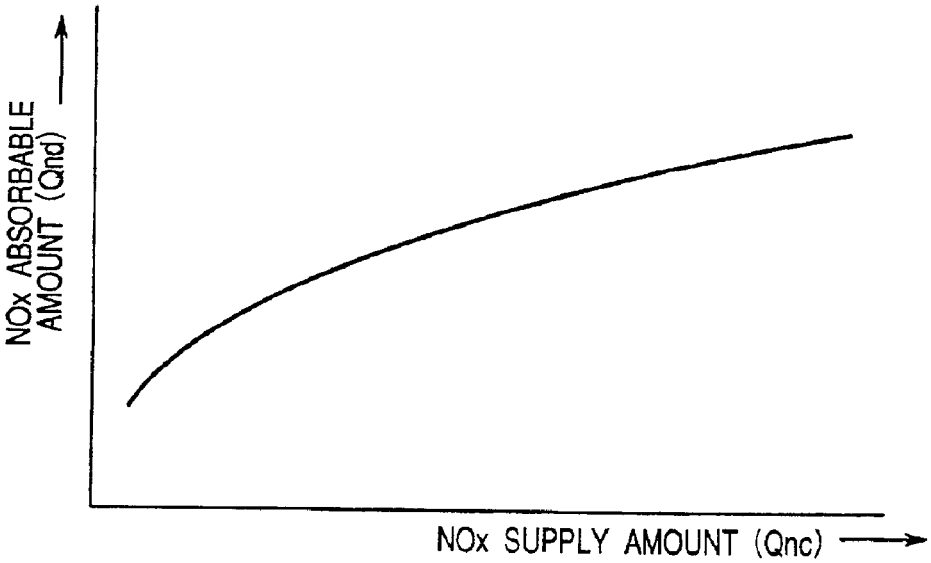
FIG. 21 is a view of characteristics.

Subsequently, at step S34, the NOx absorbable amount (Qnd) is set according to the integrated NOx absorption amount (Qnf), the exhaust gas temperature (Tmp), and the NOx supply amount (Qnc). As shown in FIG. 19, the greater the integrated NOx absorption amount (Qnf), the NOx absorbable amount (Qnd) is set to a smaller value; as shown in FIG. 20, the higher the exhaust gas temperature (Tmp), the NOx absorbable amount (Qnd) is set to a smaller value; and as shown in FIG. 21, the greater the NOx supply amount (Qnc), the NOx absorbable amount (Qnd) is set to a greater value.

Subsequently, at step S35, smaller one of the values of the NOx supply amount (Qnc) and the NOx absorbable amount (Qnd) is set as a current value of the NOx absorption amount, that is, as a momentary NOx absorption amount (Qne). Then, at step S36, the momentary NOx absorption amount (Qne) is added to the integrated NOx absorption amount (Qnf) to thereby update the integrated NOx absorption amount (Qnf). In this way, a current value is obtained for the integrated NOx absorption amount (Qnf).

Figure 5:
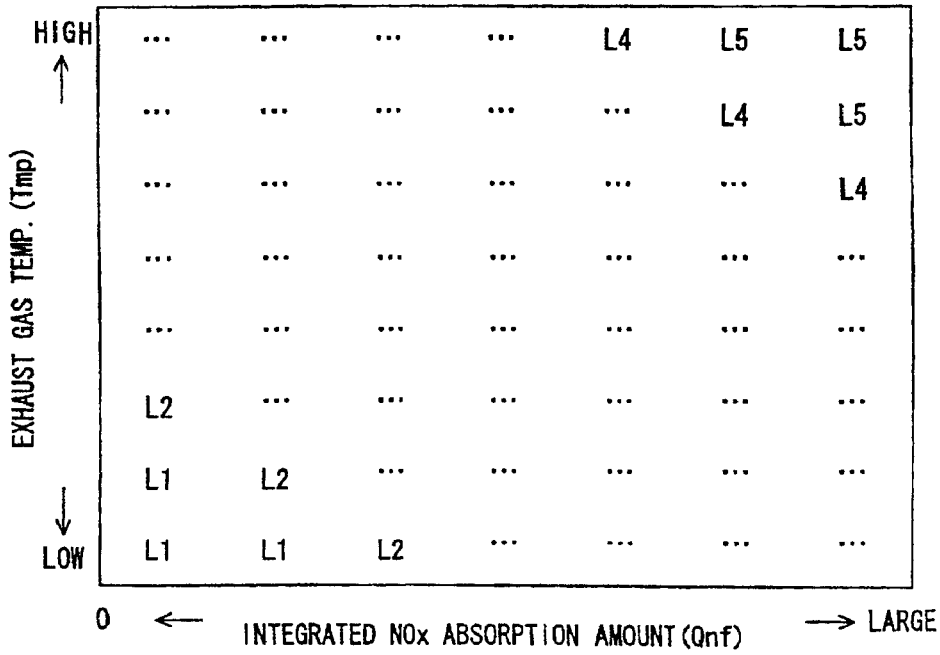
FIG. 5 is a view showing characteristics used to set the individual areas in the air fuel ratio map.
Figure 12:
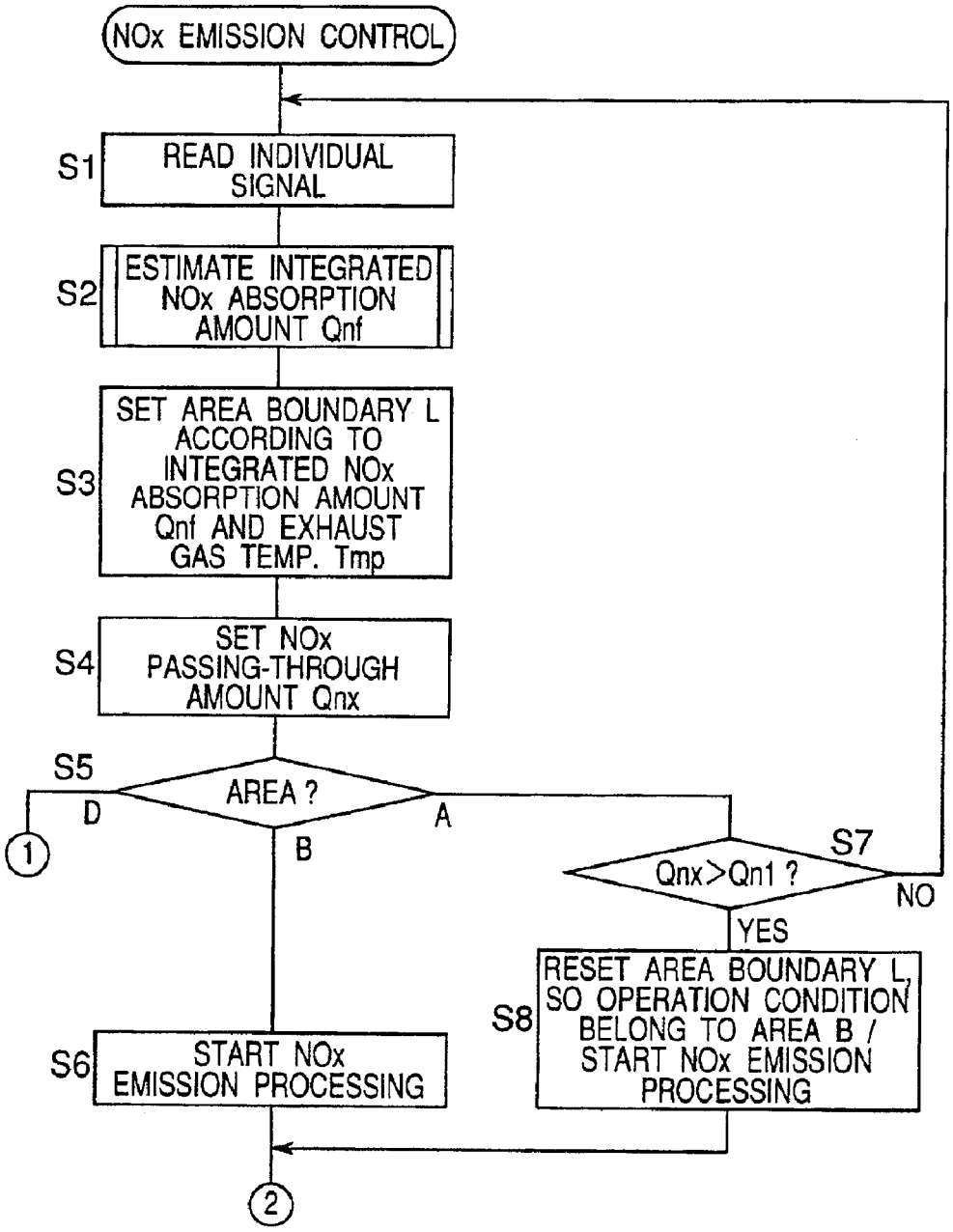
FIG. 12 is a main flowchart showing example practical operations of the NOx emission control.

Referring back to the main flow, at step S3 shown in FIG. 12, the boundary L between the lean operation area A and the enrichment operation area B in the air fuel ratio map is set according to the integrated NOx absorption amount (Qnf) and the exhaust gas temperature (Tmp). Specifically, the lean operation area A is reduced, and the enrichment operation area B is enlarged. In this step, the aforementioned map shown in FIG. 5 is used.

Subsequently, at step S4, the NOx passing-through amount (Qnx) is set. According to Expression 2 shown below, the NOx passing-through amount (Qnx) is obtained through the subtraction of the NOx absorbable amount (Qnd) from the NOx supply amount (Qnc).

$$Qnx=Qnc-Qnd \quad \text{[Expression 2]}$$

Subsequently, at step S5, the operation area is determined. As a result, if a current operation condition belongs to the enrichment operation area B set at step S3, processing proceeds to step S6. If a current operation condition belongs to the lean operation area A, processing proceeds to step S7. If the current operation condition belongs to the NOx emission processing nonexecution area D, processing returns. At step S6, the NOx emission processing starts with the enrichment of the air fuel ratio.

At step S7, a determination is made as to whether the NOx passing-through amount (Qnx) is greater than a predetermined amount (Qn1). If the answer to the step is NO, processing returns to step S1. If the answer is YES, at step 8, the boundary L between the lean operation area A and the enrichment operation area B is reset so that the current operation condition belongs to the enrichment operation area B. Specifically, the lean operation area A is further reduced, and the enrichment operation area B is further enlarged. Then, the air fuel ratio is enriched, and the NOx emission processing is started. Thereby, although the integrated NOx absorption amount (Qnf) is not equal to or greater than the integrated NOx absorption amount (Qnf), when the momentary NOx passing-through amount (Qnx) is equal to or greater than the predetermined amount (Qn1), the NOx emission processing is started.

Subsequently, at step S9 in FIG. 13, the residual NOx absorption amount (Qnh) is estimated. Specifically, at step S41 shown in FIG. 16, the current value of the NOx emission amount, namely, the momentary NOx emission amount (Qng), is set according to the air fuel ratio, a exhaust gas flow rate, the residual NOx absorption amount (Qnh), and exhaust gas temperature (Tmp).

Figure 22:
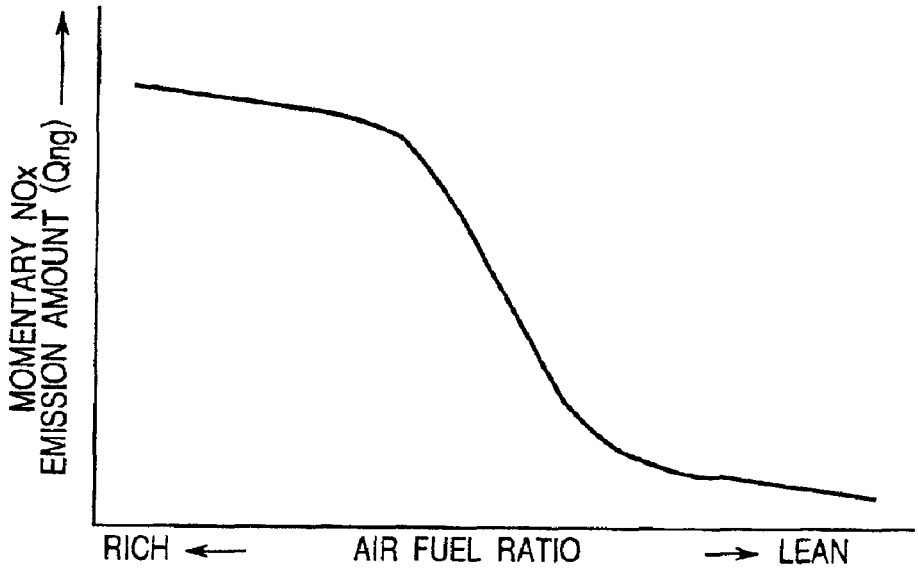
FIG. 22 is a view of characteristics.
Figure 23:
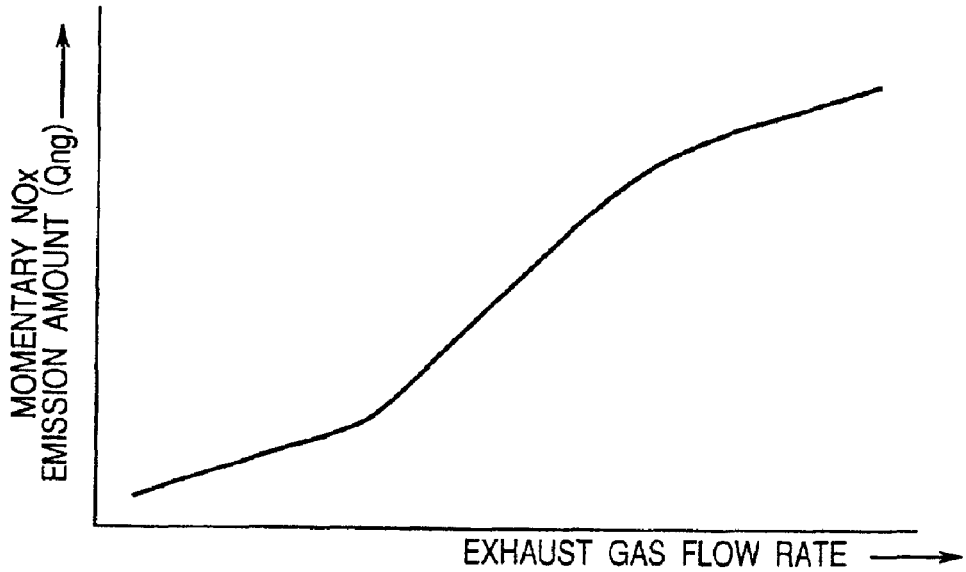
FIG. 23 is a view of characteristics.
Figure 24:
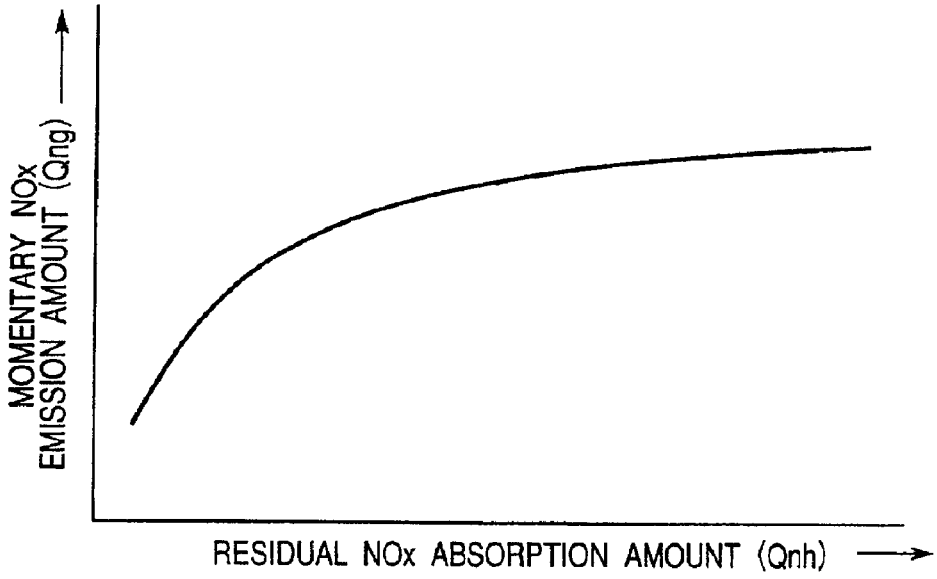
FIG. 24 is a view of characteristics.
Figure 25:
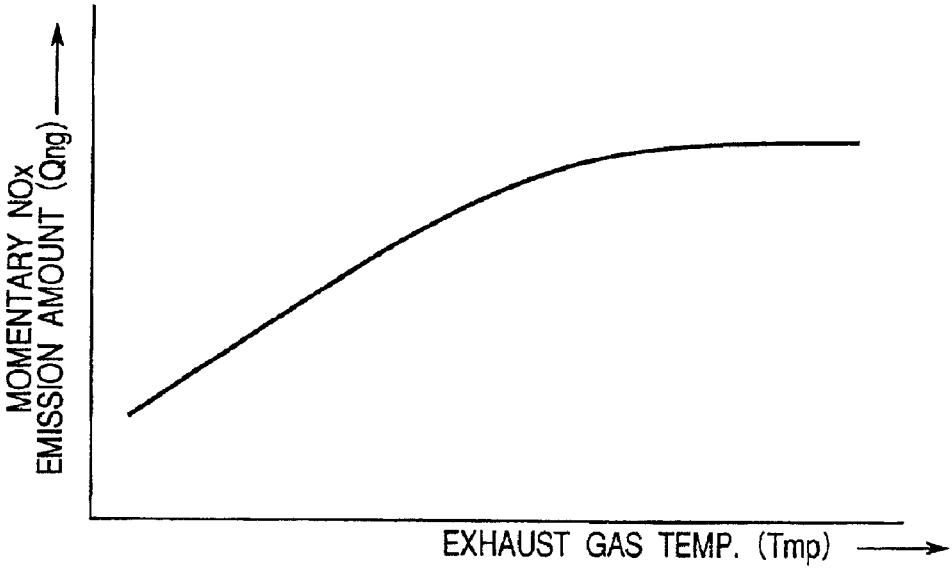
FIG. 25 is a view of characteristics.

As shown in FIG. 22, the richer the air fuel ratio, the momentary NOx emission amount (Qng) is set to a greater value; as shown in FIG. 23, the higher the exhaust gas flow rate (Tmp), it is set to a greater value; as shown in FIG. 24, the greater the residual NOx absorption amount (Qnh), it is set to a greater value; and as shown in FIG. 25, the higher the exhaust gas temperature (Tmp), it is set to a greater value.

Subsequently, at step S42, the momentary NOx emission amount (Qng) is subtracted from the residual NOx absorption amount (Qnh) to update the residual NOx absorption amount (Qnh) and to obtain a current value of the residual NOx absorption amount (Qnh).

Reference is made back to the main flow. At step S10 shown in FIG. 13, a determination is made as to whether or not the residual NOx absorption amount (Qnh) is zero. As a result, if it is determined to be zero, the NOx emission processing terminates at step S11. Specifically, the enrichment of the air fuel ratio is completed, and the operation condition is returned to the lean operation. Subsequently, at step S12, the boundary L is reset. Specifically, the reduced lean operation area A is enlarged, and the enlarged enrichment operation area B is reduced to thereby return the map to the original normal time air fuel ratio map as shown in FIG. 2. Then, processing returns.

While verifying at step S13 that the operation condition is maintained in the enrichment operation area B until the residual NOx absorption amount (Qnh) becomes zero, the residual NOx absorption amount (Qnh) is updated at step S9. The loop of steps S9, S10, and S13 is iterated; and the case wherein processing control is passed from step S10 to steps S11 and S12 corresponds to the case where the typical NOx emission processing shown by symbol aa in FIG. 4.

During the iteration of the loop of steps S9, S10, and S13, that is, during the execution of the NOx emission processing, when the operation condition is determined to have deviated from the enrichment operation area B at step S13, a determination is made at step 14 as to whether the condition has deviated to the lean operation area A or the NOx emission processing nonexecution area D. If the operation condition has deviated to the lean operation area A, processing proceeds to step S15. If the operation condition has deviated to the nonexecution area D, processing proceeds to step S18 shown in FIG. 14.

At step S15, a determination is made as to whether the residual NOx absorption amount (Qnh) is equal to or less than a predetermined amount "b". As a result, if the answer is YES, the NOx emission processing is suspended at step S16. Specifically, the enrichment of the air fuel ratio is suspended, and the operation condition is once returned to the lean operation. Then, processing returns.

In the above case, even with the residual NOx absorption amount (Qnh) being reduced, since it is not yet zero, when the integrated NOx absorption amount (Qnf) is subsequently estimated in step S2, processing is started with the aforementioned residual NOx absorption amount ($0<Qnh<b$). As a result, when the boundary L is subsequently set in step S3, a case can occur in which it is not set to the normal time position along of L1, but is set to, for example, the position along L2, where the enrichment operation area B is enlarged. Therefore, as in the case where the residual NOx absorption amount (Qnh) becomes zero, and the operation condition is returned, the area boundary L is not reset in step S12. The processing continuing through steps 13, 14, 15, and 16 and returning corresponds to a countermeasure for the case where the residual NOx absorption amount (Qnh) in the deviation to the lean operation area A shown in FIG. 6 is equal to or less than the predetermined amount "b".

Conversely, if the answer to step S15 is NO, the boundary L between the lean operation area A and the enrichment operation area B is reset so that the current operation condition belongs to the enrichment operation area B. Specifically, the lean operation area A is further reduced, and the enrichment operation area B is further enlarged. Then, the air fuel ratio is enriched, and the NOx emission processing is continued; that is, processing returns to the loop of steps S9, S10, and S13. Thereby, the NOx emission processing is continued with no idle time occurring. The processing continuing from step S13 through steps S14, S15, and S17 and returning to step S9 corresponds to a countermeasure for the case where the residual NOx absorption amount (Qnh) at the time t2 of deviation to the lean operation area A shown by symbol ee in FIG. 6 is equal to or greater than the predetermined amount "b".

In addition, in step S14, when the operation condition is determined to have been deviated to the NOx emission processing nonexecution area D, the NOx emission processing is suspended in step S14 shown in FIG. 18. Specifically, the enrichment of the air fuel ratio is unconditionally suspended, and the operation condition is once returned to the lean operation. Then, at step S19, the integrated NOx absorption amount (Qnf) is estimated in a similar manner to that in step S2; and at step S20, the boundary L is set in a similar manner to that in step 3. In this case, however, since the operation condition belongs to the NOx emission processing nonexecution area D, almost no increase is observed in the integrated NOx absorption amount (Qnf), thereby increasing the probability of maintaining the boundary L in the state where the NOx emission processing is suspended. Steps 19 and 20 described above are iterated until the operation condition is determined in step S21 to be deviated from the processing nonexecution area D.

When the operation condition has been deviated from the nonexecution area D, in step S22, a determination is made as to whether or not the integrated NOx absorption amount (Qnf) is equal to or less than the predetermined amount "c". As a result, if the answer is YES, processing simply returns. Specifically, regardless of whether the operation condition has deviated from the NOx emission processing nonexecution area D to the lean operation area A or the enrichment operation area B, the NOx emission processing is totally suspended, and processing returns to step S1. The condition is similar to that where the residual NOx absorption amount (Qnh) when the operation condition deviates from the aforementioned enrichment operation area B to the lean operation area A is equal to or less than the predetermined amount "b" (when processing continues through steps S13, S14, S15, and S16 and returns). The processing continuing through steps S18, S21, and S22 corresponds to a countermeasure for the case where the integrated NOx absorption amount (Qnf) at the time of deviation from the NOx emission processing nonexecution area D is equal to or less than the predetermined amount "c".

Conversely, if the answer to step 22 is NO, a determination is made at step 23 as to whether the operation condition has deviated from the NOx emission processing nonexecution area D to the lean operation area A or to the enrichment operation area B. If the operation condition has deviated to the enrichment operation area B, processing proceeds to step S24; whereas, if the operation condition has deviated to the lean operation area A, processing proceeds to step S25.

At step S24, the NOx emission processing is restarted; that is, the enrichment of the air fuel ratio resumes. Then, processing returns to the loop of steps S9, S10, and S13. Thereby, the continuation steps of the NOx emission processing are immediately performed after suspension caused due to the nonexecution area D. The processing continuing from step S18 through steps S21, S22, S23, and S24 and returning to step S9 corresponds to a countermeasure for the case where the operation condition has deviated from the NOx emission processing nonexecution area D shown by symbol gg in FIG. 7 to the enrichment operation area B.

At step S25, the boundary L between the lean operation area A and the enrichment operation area B is reset so that the current operation condition belongs to the enrichment operation area B. Specifically, the lean operation area A is further reduced, and the enrichment operation area B is further enlarged. Then, the air fuel ratio is enriched, and the NOx emission processing is thereby resumed; that is, processing returns to the loop of steps S9, S10, and S13. Thereby, continuation steps of the NOx emission processing is immediately performed after suspension caused by nonexecution area D. The processing continuing from step S18 through steps S21, S22, S23, and S25 and returning to step S9 corresponds to a countermeasure for the case where the operation condition has deviated from the NOx emission processing nonexecution area D shown by jj in FIG. 8 to the lean operation area A and where the integrated NOx absorption amount (Qnf) at the time of deviation (t4) to the lean operation area A is equal to or greater than the predetermined amount "c".

The NOx catalyst 17 is problematic in regard to sulfur poisoning. It adsorbs a fuel-sulfur component, in addition to the absorption of the NOx component. As a matter of course, when the amount of sulfur adsorption is equal to or greater than a predetermined amount, sulfur emission control to emit sulfur from the catalyst 17 is performed. The sulfur emission control is implemented by, for example, enriching the air fuel ratio and concurrently increasing the temperature of the catalyst 17. The sulfur emission control is performed at a frequency significantly lower than that of the above-described NOx emission control. However, in a period before the sulfur emission control is executed, it is not deniable that the NOx purification capability of the NOx catalyst 17 is influenced by the sulfur poisoning.

In view of the above problem, preferably, the integrated NOx absorption amount (Qnf) is corrected and reduced with a sulfur adsorption amount (Qs) according to, for example, Expression 3 shown below.

$$Qnfa(\text{correction NOx absorption amount}) = Qnf \times (1 - Qs) \quad \text{[Expression 3]}$$

One of values (ratios) ranging from "0" to "1" is assigned as the sulfur adsorption amount (Qs) to the above Expression. Value "0" represents the adsorption amount when no sulfur component cannot be adsorbed in the NOx catalyst 17; and value "1" represents the adsorption amount when no NOx component is substantially adsorbed in the NOx catalyst 17 at all.

In addition, the sulfur adsorption amount (Qs) is estimated on the basis of the fuel supply amount. The estimated value is corrected according to an intrafuel sulfur content, a catalyst temperature (exhaust gas temperature), a lean operation continuation time, a sulfur poisoning amount (integrated sulfur adsorption amount), and so forth. Thereby, the estimation accuracy can be improved.

Figure 13:
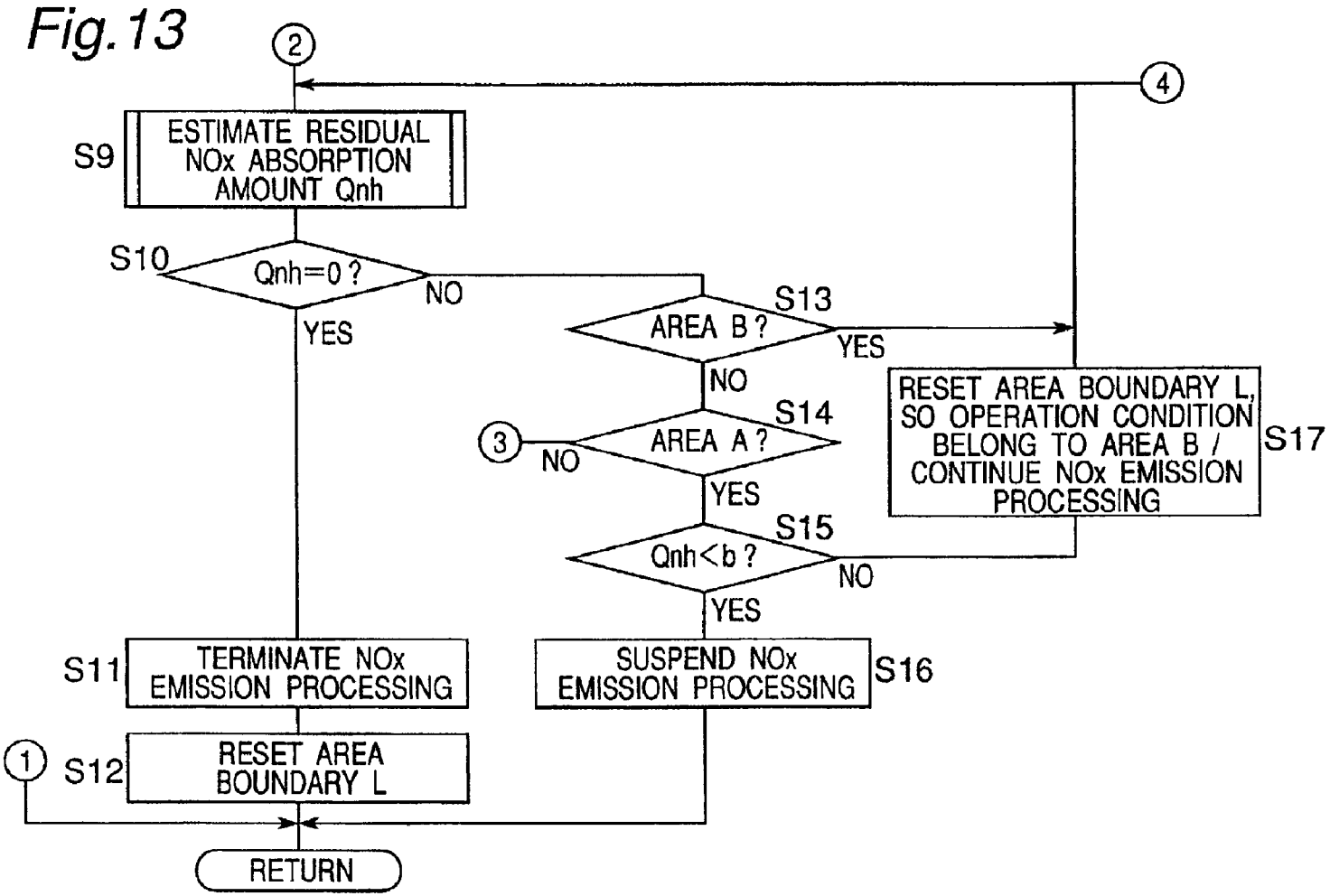
FIG. 13 is a part of the main flowchart.
Figure 14:
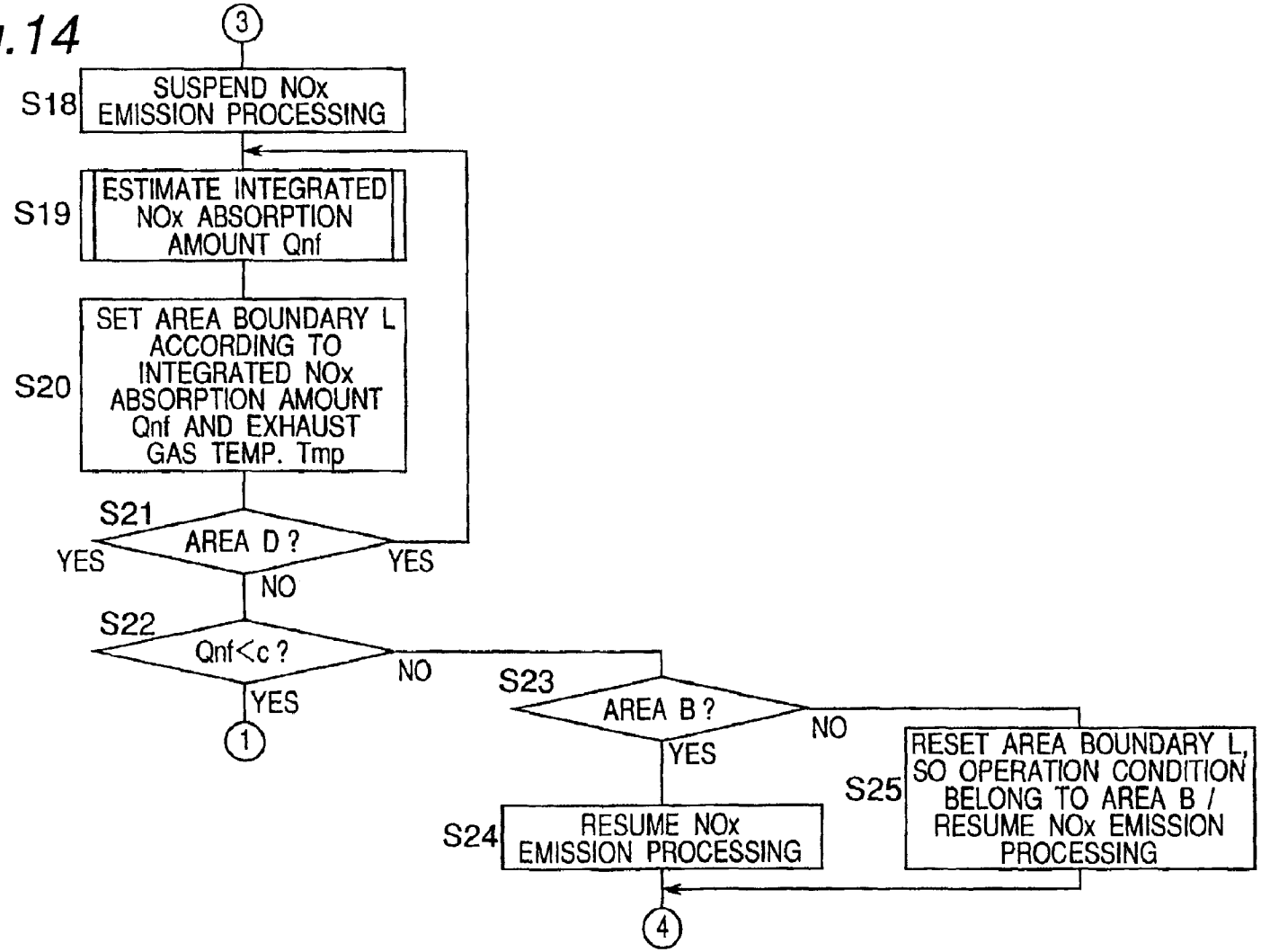
FIG. 14 is another part of the main flowchart.
Figure 15:
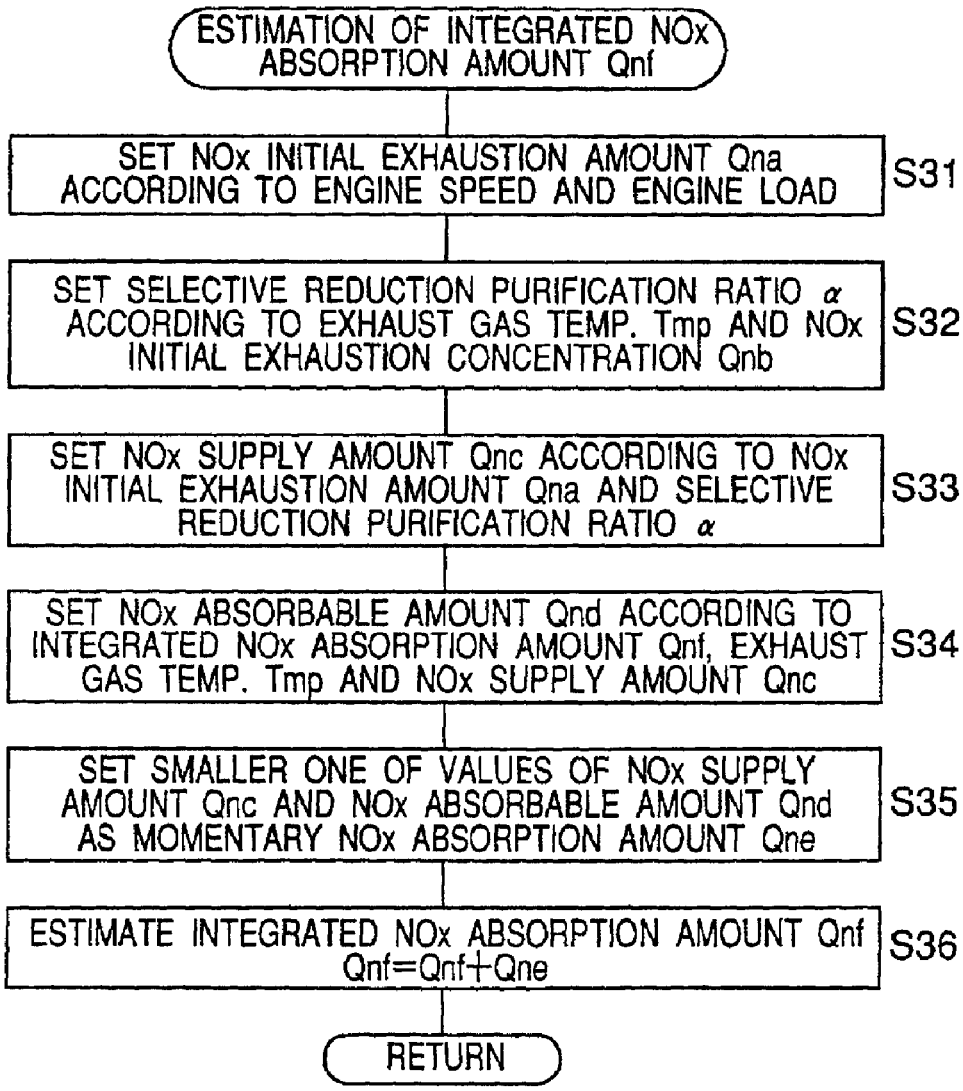
FIG. 15 is sub-flowchart.
Figure 16:
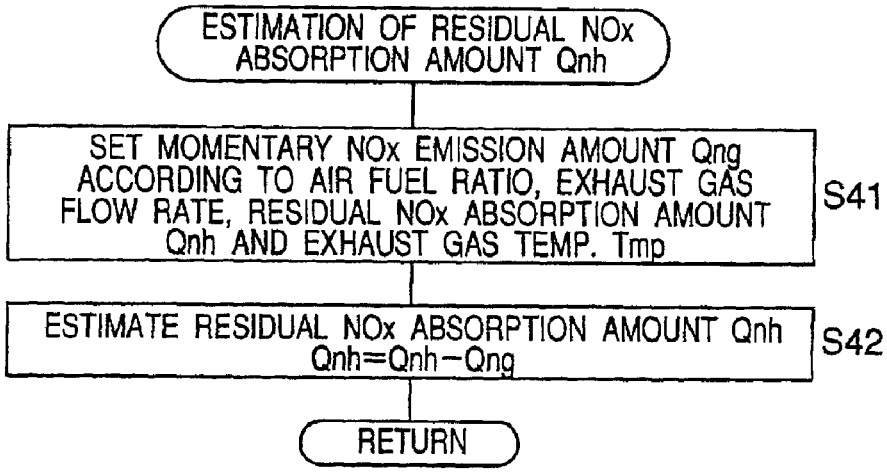
FIG. 16 is another sub-flowchart.

Moreover, in the above, the configuration employs a method in which the boundary L is reset in, for example, step S17 shown in FIG. 13 and step S25 shown in FIG. 14 so that the operation condition belongs to the enrichment operation area B, and the NOx emission processing is thereby continued or resumed. Alternatively, however, the configuration may employ a different method, for example, as another embodiment.

In specific, when the NOx emission processing is started in step S6 shown in FIG. 12, a NOx purge execution flag (fnox) is set. The NOx emission processing is continued either until the operation condition shifts to the nonexecution area D or until the residual NOx absorption amount (Qnh) becomes zero. However, the NOx purge execution flag (fnox) is set only when the residual NOx absorption amount (Qnh) becomes zero. Accordingly, for example, in a state where the operation condition shifts to the NOx emission processing nonexecution area D, when the residual NOx absorption amount (Qnh) is not zero, the NOx purge execution flag (fnox) is not reset, but remains to be set.

As a result of the above, in a period after the NOx emission processing starts, when the operation condition once shifts to the NOx emission processing nonexecution area D, and the operation condition then deviates from the nonexecution area D, if the NOx purge execution flag (fnox) is set, the NOx emission processing is immediately executed regardless of whether the operation condition has deviated to the lean operation area A or to the enrichment operation area B.

As described above, according to the present invention, the momentary NOx absorption amount is corrected based on the integrated NOx absorption amount, thereby allowing the integrated NOx absorption amount to be accurately estimated. As a result, the NOx emission control can be performed with appropriate timing, and the purification performance of the NOx catalyst and the fuel consumption performance can be maintained at best possible conditions. The present invention can be widely and suitably applied to general purpose engines employing a catalyst of a NOx-absorbing-and-reducing type.

Although the present invention has been fully described in connection with the preferred embodiments thereof with reference to the accompanying drawings, it is to be noted that various changes and modifications are apparent to those skilled in the art. Such changes and modifications are to be understood as included within the scope of the present invention as defined by the appended claims unless they depart therefrom.

What is claimed is:

1. An apparatus for purifying an exhaust gas of an engine, said apparatus comprising:

a catalyst for a NOx absorbing-and-reducing type disposed in an exhaust passage, for absorbing a NOx component in the exhaust gas under an over-oxygen atmosphere and for reductively emitting the absorbed NOx component according to a reduction of an oxygen concentration;

a momentary NOx absorption amount estimation section for estimating a momentary amount of the NOx component absorbed in said catalyst on the basis of a unit time;

an integrated NOx absorption amount estimation section of estimating an integrated amount of the NOx component absorbed in said catalyst according to the integration of momentary amounts estimated by the estimation section;

a NOx emitting section for letting said catalyst to emit the NOx component when the integrated amount estimated by the estimation section is equal to or greater than a predetermined absorption amount;

a momentary NOx absorption amount correcting section for correcting the momentary amount estimated by said momentary NOx absorption amount estimation section to a value smaller in adverse proportion to the increase in the integrated amount estimated by said integrated NOx absorption amount estimation section;

a momentary NOx supply amount setting section for setting a momentary amount of the NOx component supplied on the basis of a unit time to the catalyst; and a momentary NOx absorbable amount setting section for setting a momentary amount of the NOx component that can be absorbed in the catalyst on the basis of a unit time, wherein said momentary NOx absorption amount estimation section determines smaller one of the values of the momentary amounts, which have been set by said setting section, to be a momentary NOx absorption amount.

2. The apparatus according to claim 1, further comprising a NOx passing-through amount setting section for setting the amount of a NOx component passing through without being absorbed in the catalyst, wherein said NOx emitting section lets said catalyst to emit the NOx component also when a passing-through amount set by the setting section is equal to or greater than a predetermined amount.

3. The apparatus according to claim 1, further comprising:

a momentary NOx initial exhaustion amount setting section for setting a momentary amount of the NOx component exhausted on the basis of a unit time from a combustion chamber; and a momentary NOx purification amount setting section for setting a momentary amount of the NOx component that is reductively purified by the catalyst on the basis of a unit time, wherein said momentary NOx supply amount setting section determines a value, which is obtained through subtraction of a momentary NOx purification amount set by said purification amount setting section from a momentary NOx initial exhaust amount set by said exhaust amount setting section, to be a momentary NOx supply amount.

4. The apparatus according to claim 1, further comprising an exhaust gas temperature detection section for detecting an exhaust gas temperature, wherein said momentary NOx absorbable amount setting section sets the momentary NOx absorbable amount according to at least one of the exhaust gas temperature detected by the detection section and the momentary NOx supply amount set by said momentary NOx supply amount setting section.

5. The apparatus according to claim 1, wherein said momentary NOx absorbable amount setting section sets the momentary NOx absorbable amount according to the momentary NOx supply amount set for said momentary NOx supply amount setting section, wherein the greater the NOx supply amount is, the NOX absorbable amount is set to a greater value.

* * * * *